US012589327B2

(12) United States Patent
Contes

(10) Patent No.: US 12,589,327 B2
(45) Date of Patent: Mar. 31, 2026

(54) RACE START GATE ASSEMBLY

(71) Applicant: Andrew Contes, Phoenix, AZ (US)

(72) Inventor: Andrew Contes, Phoenix, AZ (US)

( * ) Notice: Subject to any disclaimer, the term of this patent is extended or adjusted under 35 U.S.C. 154(b) by 751 days.

(21) Appl. No.: 18/076,783

(22) Filed: Dec. 7, 2022

(65) Prior Publication Data

US 2023/0173401 A1 Jun. 8, 2023

Related U.S. Application Data

(60) Provisional application No. 63/398,595, filed on Aug. 17, 2022, provisional application No. 63/307,159, filed on Feb. 6, 2022, provisional application No. 63/287,512, filed on Dec. 8, 2021.

(51) Int. Cl.
*A63K 3/02* (2006.01)

(52) U.S. Cl.
CPC ..... *A63K 3/02* (2013.01)

(58) Field of Classification Search
CPC . A63K 3/02; A63K 3/023; E01F 13/06; E01F 13/065; E01F 13/08; E01F 13/10; E01F 13/105; E01F 13/085
See application file for complete search history.

(56) References Cited

U.S. PATENT DOCUMENTS 4,134,230 A * 1/1979 Roy ..... A63K 3/02 49/131
7,665,929 B2 * 2/2010 Barker, III ..... A63K 3/02 404/9
7,845,876 B2 * 12/2010 Burry ..... A63K 3/02 404/6
7,900,399 B2 * 3/2011 Williams ..... A63K 3/023 404/9
9,919,236 B1 * 3/2018 Gross ..... A63K 3/02
11,873,610 B2 * 1/2024 Herrera ..... E01F 13/08
2005/0069383 A1 * 3/2005 Gunderson ..... A63K 3/02 404/6
2006/0029467 A1 * 2/2006 Johnson ..... A63K 3/02 404/60
2007/0207868 A1 * 9/2007 Burry ..... A63K 3/02 472/85
2007/0248409 A1 * 10/2007 Barker ..... E01F 13/085 404/6
2008/0222960 A1 * 9/2008 Williams ..... A63K 3/023 49/324

* cited by examiner

*Primary Examiner* — Abigail A Risic
(74) *Attorney, Agent, or Firm* — Galvani Smith PLLC; Thomas W. Galvani

(57) ABSTRACT

A gate assembly for a bicycle race start includes a plurality of gates, each mounted in a separate start position along a bar to move between a closed position and an open position. The bar is moveable between a first condition and a second condition. The assembly includes buttresses, each coupled to the bar to move between first positions and second positions in response to movement of the bar between the first condition and the second condition, wherein each buttress corresponds to a respective one of the gates. In the first condition of the bar, each buttress disables movement of the respective gate from the closed position to the open position. In the second condition of the bar, each buttress enables movement of the respective gate from the closed position to the open position.

20 Claims, 12 Drawing Sheets

RACE START GATE ASSEMBLY

CROSS-REFERENCE TO RELATED APPLICATIONS

This application claims the benefit of U.S. Provisional Application No. 63/287,512, filed Dec. 8, 2021, of U.S. Provisional Application No. 63/307,159, filed Feb. 6, 2022, of U.S. Provisional Application No. 63/398,595, filed Aug. 17, 2022, all of which are hereby incorporated by reference.

FIELD

The present specification relates generally to gates, and more particularly to starting gates used in sporting events such as BMX races.

BACKGROUND

There are many different kinds of starting gates in sporting events, and athletes use those gates in different ways. In road cycling, a starting gate may be nothing more than an extended hand preventing the cyclist from pedaling out before a whistle. In triathlon, a starting gate is an open archway that electronically registers when an athlete passes through. In BMX racing, a starting gate is a physical barrier blocking forward movement of the racers until the gate drops.

Conventionally, BMX gates consist of a single, long, rectangular barrier extending in front of all the starting positions. The barrier is usually quite heavy, constructed of square aluminum or steel tubing with metal mesh between. The barrier drops or pivots away from the riders when an actuator in the middle of the track pushes the barrier down. With the weight of the barrier and the push of the actuator, the barrier moves quickly and with a great deal of momentum.

Unfortunately, the barrier moves regardless of the riders' positions. Typically, at a BMX race start, riders perform track stands with their front tires resting against the barrier. A track stand requires a rider to balance his bike in an upright position; his feet are on the pedals and do not touch the ground. Then, when the barrier drops, the rider pedals furiously to launch forward.

Track stands require skill and experience, and younger riders often lack both. As such, occasionally a young rider will fall at the starting gate while attempting a track stand. If the rider falls well before the start, he can collect himself, stand up, and rest. However, sometimes, the rider falls just before the start, and he falls forward. When a rider falls forward, he can actually get in front of and under the falling barrier. This poses a serious danger. Many young riders have suffered injuries, such as broken bones and lost fingers, when they have fallen over the barrier and it closes on their body. An improved starting gate is needed.

SUMMARY

In an embodiment of a gate assembly for a bicycle race start, the gate assembly includes a plurality of gates, each mounted in a separate start position along a bar to move between a closed position and an open position. The bar is moveable between a first condition and a second condition. The assembly includes buttresses, each coupled to the bar to move between first positions and second positions in response to movement of the bar between the first condition and the second condition, wherein each buttress corresponds to a respective one of the gates. In the first condition of the bar, each buttress disables movement of the respective gate from the closed position to the open position. In the second condition of the bar, each buttress enables movement of the respective gate from the closed position to the open position.

In embodiments, the gates are mounted for free pivotal movement on the bar. Each buttress includes rings fixed to the bar to pivot with the bar, a post projecting from each of the rings to pivot with the bar, a brace extending laterally between the posts and across an underside of the gate. The rings of each buttress are outboard of the respective gate. Each gate includes a plate having an upstream end and an opposed downstream end, and a mass damper having a weight mounted for reciprocal movement between the upstream and downstream ends and for movement away from an underside of the gate. In embodiments, each gate includes an upstream face and a tread plate formed into the upstream face, the tread plate including a recessed surface below the upstream face and a plurality of projections arranged in columns projecting upwardly from the recessed surface. The upstream face of each gate further includes slots extending laterally across the upstream face. Each gate further includes a spring biasing the gate toward the open position.

In an embodiment of a gate assembly for a bicycle race start, the gate assembly includes a plurality of gates mounted to a bar for pivotal movement between an upright position and a collapsed position for respectively closing and opening separate starting positions upstream of the gates. The gate assembly includes buttresses, each mounted downstream of a corresponding respective gate, wherein each buttress is moveable between a first position and a second position. In the first position of the buttress, the corresponding respective gate is disabled from moving from the closed position to the open position. In the second position of the buttress, the corresponding respective gate is enabled to move from the closed position to the open position.

In embodiments, the gates are mounted for free pivotal movement on the bar. Each buttress includes posts projecting from the bar to pivot with the bar, and a brace extending laterally between the posts and across an underside of the gate. Each gate includes a plate having an upstream end and an opposed downstream end, and a mass damper having a weight mounted for reciprocal movement between the upstream and downstream ends and for movement away from an underside of the gate. In embodiments, each gate includes an upstream face and a tread plate formed into the upstream face. The tread plate includes a recessed surface below the upstream face and a plurality of projections arranged in columns projecting upwardly from the recessed surface. In embodiments, the upstream face of each gate further includes slots extending laterally across the upstream face. In embodiments, each gate further includes a spring biasing the gate toward the collapsed position.

In an embodiment of a gate assembly for a bicycle race start, the gate assembly includes a plurality of gates, each mounted in a separate start position along a bar to move between a closed position and an open position. The gate assembly includes stop means on the bar which moves with the bar between first and second positions. In the first position, the stop means disables movement of the gates from the closed position to the open position. In the second position, the stop means enables movement of the gates from the closed position to the open position.

In embodiments, the gates are mounted for free pivotal movement between the closed and open positions. Each gate includes a plate having an upstream end and an opposed downstream end, and a mass damper having a weight mounted for reciprocal movement between the upstream and downstream ends and for movement away from an underside of the gate. In embodiments, each gate includes an upstream face, and a tread plate formed into the upstream face, the tread plate including a recessed surface below the upstream face and a plurality of projections arranged in columns projecting upwardly from the recessed surface. In embodiments, the stop means includes, for each gate, a post projecting from the bar to pivot with the bar and confront an underside of the gate. In embodiments, the stop means includes, for each gate a post projecting from the bar to pivot with the bar, and a brace coupled to the post and extending laterally across an underside of the gate to confront the underside of the gate. In embodiments, the stop means includes posts projecting from the bar to pivot with the bar, and a brace extending between the posts and across all of the gates to confront an underside of the gates.

The above provides the reader with a very brief summary of some embodiments described below. Simplifications and omissions are made, and the summary is not intended to limit or define in any way the disclosure. Rather, this brief summary merely introduces the reader to some aspects of some embodiments in preparation for the detailed description that follows.

BRIEF DESCRIPTION OF THE DRAWINGS

Referring to the drawings.

DETAILED DESCRIPTION

Figure 1A:
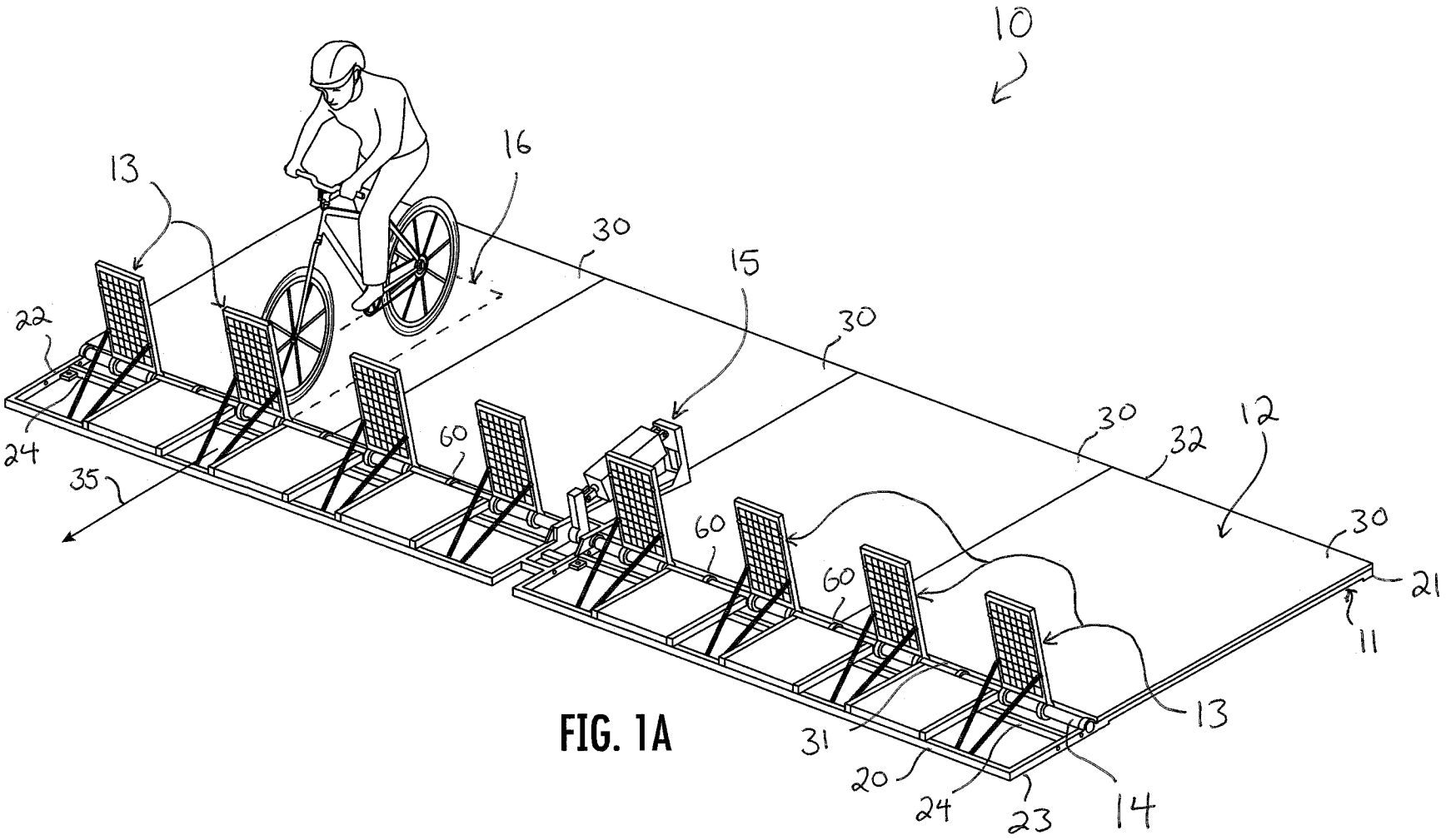
FIGS. 1A and 1B are perspective views of an embodiment of a race start gate assembly including a plurality of gates mounted for movement between raised positions and collapsed positions.

Reference now is made to the drawings, in which the same reference characters are used throughout the different figures to designate the same elements. Briefly, the embodiments presented herein are preferred exemplary embodiments and are not intended to limit the scope, applicability, or configuration of all possible embodiments, but rather to provide an enabling description for all possible embodiments within the scope and spirit of the specification. Description of these preferred embodiments is generally made with the use of verbs such as "is" and "are" rather than "may," "could," "includes," "comprises," and the like, because the description is made with reference to the drawings presented. One having ordinary skill in the art will understand that changes may be made in the structure, arrangement, number, and function of elements and features without departing from the scope and spirit of the specification. Further, the description may omit certain information which is readily known to one having ordinary skill in the art to prevent crowding the description with detail which is not necessary for enablement. Indeed, the diction used herein is meant to be readable and informational rather than to delineate and limit the specification; therefore, the scope and spirit of the specification should not be limited by the following description and its language choices.

FIG. 1A shows a race start gate assembly 10 for a bicycle race start. The gate assembly 10 shown is useful for timing the start of a BMX race, preventing false starts, and making starts much safer than conventional race equipment. The gate assembly 10 is typically constructed or installed on site on a BMX start hill, which is a steep hill about five meters high. FIG. 1A does not show the degree of incline, but one having ordinary skill in the art will readily understand the placement of the gate assembly 10 on the hill. In some embodiments, the gate assembly 10 is installed or sunk into a pre-dug shallow recess on the hill, while in other embodiments, the gate assembly 10 is installed above ground, on scaffolding or other structural support, so as to lift the gate assembly 10 up at an incline corresponding to the angle a start hill.

The gate assembly 10 shown in FIG. 1A includes eight start positions, with a rider shown behind one of those start positions. Embodiments of the gate assembly 10 may have a greater number of start positions or a fewer number, including even just a single start position. The operation of all such embodiments is generally the same, and the structures are similar. The following specification describes the structure of the embodiment of the gate assembly 10 shown in FIG. 1A as an example for all embodiments.

The gate assembly 10 includes a framework 11, a starting deck 12, and a plurality of gates 13 coupled to a common bar 14 controlled by an actuator 15.

The framework 11 is a rigid, rugged, durable structure supporting the gate assembly 10. The framework 11 includes front and back frame elements 20 and 21 and side frame elements 22 and 23 extending therebetween. The frame elements are preferably tubular, square-tubed, lengths of aluminum, steel, or other strong metal. Lateral spar elements 24 extend between the side frame elements 22 and 23, preferably just downstream of the common bar 14. As an aside, the words "upstream" and "downstream" are used in this specification to refer to locations or relative locations of parts, with "upstream" meaning near to or nearer to the back frame element 21 and "downstream" meaning near to or nearer to the front frame element 20. Other hidden lateral spar elements extend between the side frame elements 22 and 23 just upstream of the common bar 14. Those are not shown in FIG. 1A. Also not shown in these drawings are a plurality of longitudinal spar elements extending between that hidden lateral spar element and the back frame element 21 (though one longitudinal spar element is shown in the section views of FIGS. 3A and 3B). The front and back frame elements 20 and 21, the side frame elements 22 and 23, the lateral spar elements 24, the hidden lateral spart elements, and the longitudinal spar elements cooperate to form the framework 11 and provide it with its rigid, rugged, and durable characteristics. The framework 11 is preferably welded or otherwise fastened together.

The starting deck 12 overlies a portion of the framework 11. The starting deck 12 is preferably formed from one or several rigid panels 30. The rigid panels 30 lay in abutting contact with each other to form a single, continuous platform on which the racers are supported before the start of the race. Fasteners secure the panels 30 to the underlying framework 1. The fasteners are not shown in FIG. 1A, but are preferably bolts, screws, nails, or like fasteners. The starting deck 12 has a downstream end 31 which is just upstream of the common bar 14, and an upstream end 32 which preferably overlies and is secured to the back frame element 21. The starting deck 12 thus provides a stable support surface across the entire gate assembly 10 upstream of the common bar 14. In embodiments, the panels 30 are plywood. In other embodiments, the panels 30 are sheet metal. In yet other embodiments, the panels 30 are thick plastic grating. Any strong, flat material suitable for supporting racers is within the scope of this disclosure. In embodiments in which the panels 30 are smooth, the upper surfaces are preferably treated or applied with a non-slip, high grip texture, such as grip tape or the like.

Figure 1B:
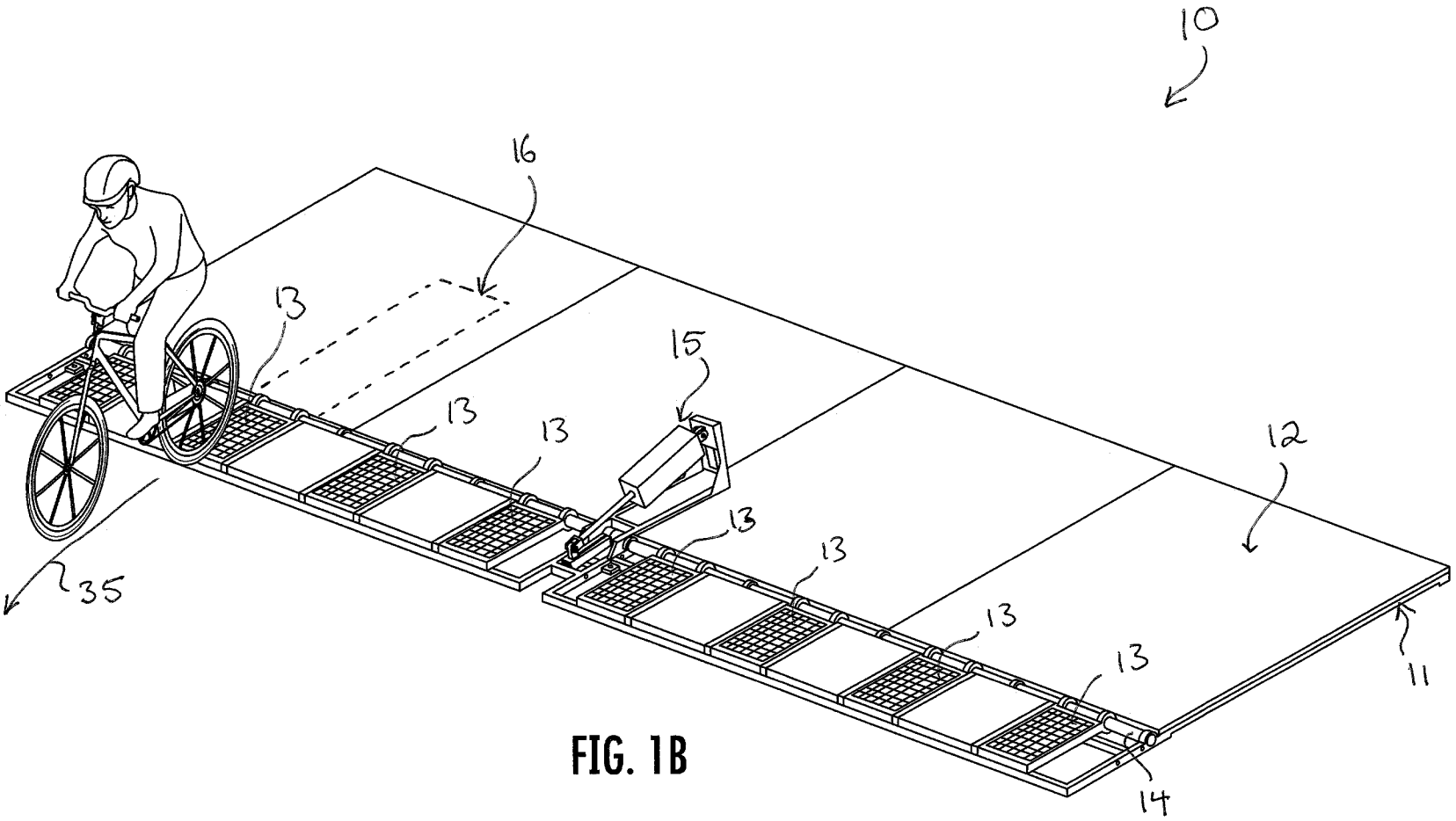

When a racer readies himself at the start of a race, he lines up behind one of the gates 13 in a starting position 16 upstream of the gates 13. Since FIG. 1A shows eight gates, there are eight separate starting positions 16 spaced apart across gate assembly 10. One of the starting positions is shown in broken line. The starting position is the location upstream of each gate 13 in which the racer waits before the race start. From the starting position, a launch path 35 extends forward and downstream for each racer. The launch path 35 is shown for the lone racer in FIG. 1A: it extends beyond the gate 13 and down the start hill. Each gate 13 has its own respective launch path extending forwardly. Before the start of the race, the gate 13 obstructs the launch path 35 and prevents the racer from moving forward along it. At the start of the race, as shown in FIG. 1B, the gate 13 collapses, the launch path 35 opens, and the racer moves forward. Each gate 13 controls the ability of the racer behind it to move forward. Each gate 13 also protects the racer from injuring himself in a pre-start fall.

Figure 2A:
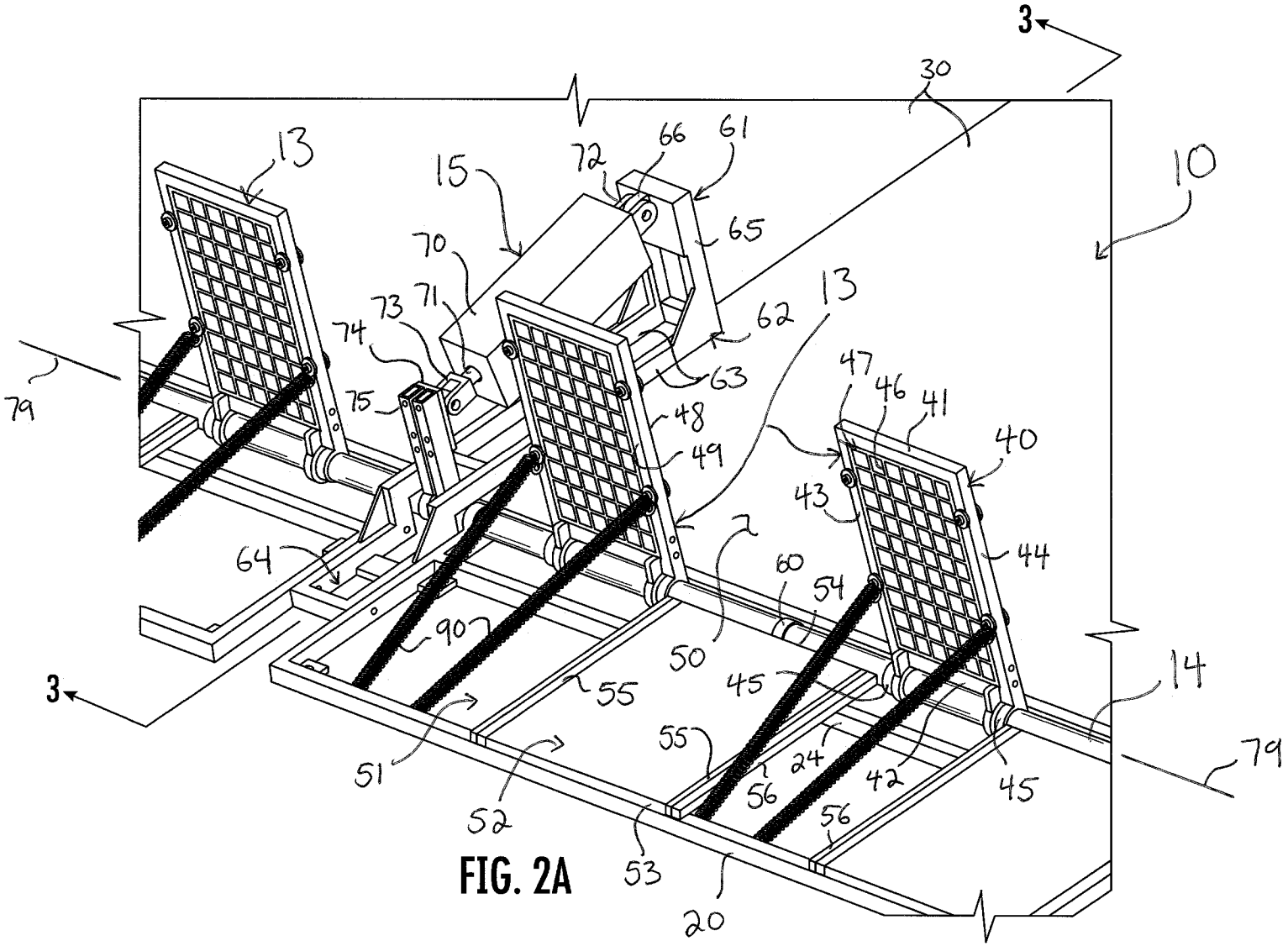
FIGS. 2A and 2B are enlarged perspective views showing some of the gates of the gate assembly of FIG. 1A in raised positions and collapsed positions.
Figure 2B:
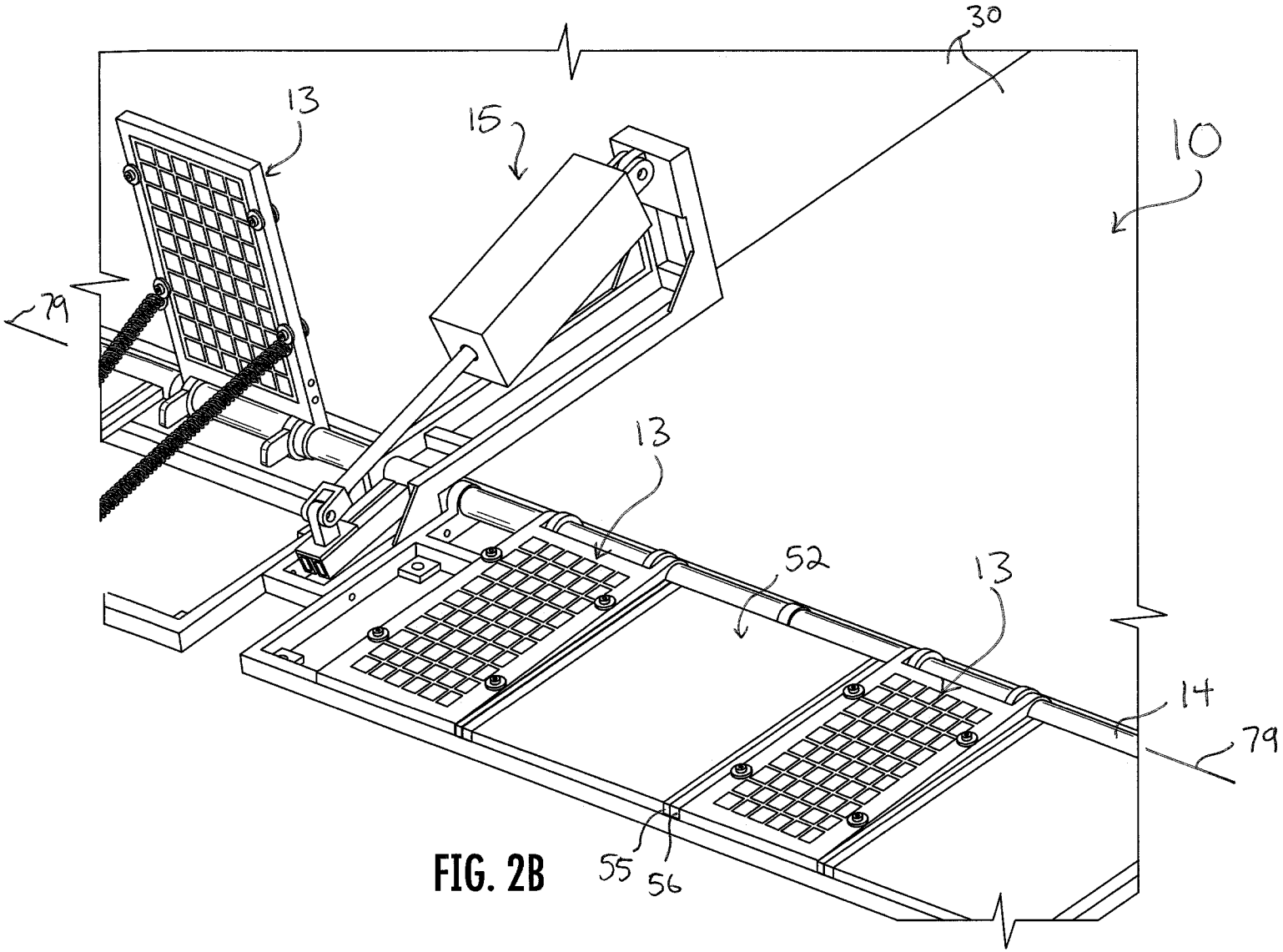

FIGS. 2A and 2B illustrate a few of the gates 13 in detail. Two gates 13 are in the collapsed position after the start of the race, but one of the gates 13 remains in the raised position, as if an obstacle were blocking it from collapsing. The gates 13 are identical in structure and differ only in location on the gate assembly 10. As such, description herein is made without distinction between the gates 13, each gate 13 has the same structural elements and features and thus the same reference characters are used for all of the gates 13, and the reader will understand that the description applies equally to all gates 13. Some of the reference characters are applied to some gates 13 while other reference characters are applied to other gates 13, but the reader will understand that each gate 13 has all the structural elements and features marked by all the reference characters of the gates 13.

The gate 13 includes a frame 40. The frame 40 is roughly rectangular and has a topside 48 and an opposed underside 49. The underside 49 includes all structure on downstream side of the gate 13 which is directed downstream. Several structural elements secured or welded together form the frame 40, including a first end 41, an opposed second end 42, and opposed first and second sides 43 and 44 extending between the first and second ends 41 and 42. The first end 41, second end 42, first side 43, and second side 44 are preferably constructed from aluminum or steel square tube or the like and are welded together to form a rectangle. The first end 41 is a free end and a downstream end, and the second end 42 is a pivoted end and an upstream end.

Two rings 45 are integrally formed to the second end 42 and extend away from the first end 41 as projections of the first and seconds sides 43 and 44. The rings 45 space the second end 42 slightly away from the common bar 14 so that there is a gap between the common bar 14 and the second end 42. The rings 45 define closed circles. The rings 45 project from the second end 42 in an upstream direction and are each centered below the underside 49 of the frame 40. The rings 45 are coaxial and share an axis which is parallel to the rectangle defined by the frame 40 (and parallel to the first and second ends 41 and 42) but offset from the plane defined by that rectangle for the frame 40. The rings 45 have a common inner diameter which corresponds to the outer diameter of the common bar 14. The rings 45 are fit over the common bar 14, such that the rings 45 may freely spin, rotate, or pivot over the common bar 14. In embodiments, the rings 45 carry bearings, bearing hubs, or other assemblies which reduce friction between the gate 13 and the common bar 14, such that the gate 13 can freely pivot on the common bar 14.

The frame 40 of the gate 13 bounds an otherwise open area 47 in which a decking 46 is held. The decking 46 provides a support surface on the topside 48 of the gate 13 for the launch path 35. The decking 46 is a strong, flat material suitable for supporting the weight of racers moving down the launch path 35. Like the rigid panels 30, the decking 46 may be constructed of plywood, sheet metal, or thick plastic grating, as FIGS. 2A and 2B show. In embodiments in which the decking 46 is smooth, the upper surfaces are preferably treated or applied with a non-slip, high grip texture, such as grip tape or the like. The decking 46 preferably occupies the entire open area of the frame 40 such that there are no gaps between the decking 46 and the frame 40. In these drawings, the decking 46 is held in place in the frame 40 by fasteners: bolts fit with washers on either side of the decking 46 and tightened and secured with nuts. In other embodiments, a strong epoxy or other adhesive is sufficient to hold the decking 46 in the frame 40.

The gate 13 is mounted on the common bar 14, with the rings 45 receiving and encircling the common bar 14, for free rotational or pivotal movement between a first position and a second position. The first position is shown in FIG. 2A; this position is also considered an upright position, a raised position, a closed position, and a blocking position. The second position is shown in FIG. 2B; this position is also considered a collapsed position, a lowered position, an open position, and a passing position. Generally, but not always, and without limitation, this specification refers to the two positions as upright and collapsed positions. The gate 13 is mounted to freely move between the upright and collapsed positions on the common bar 14. The gate 13 falls from the upright position to the collapsed position when it is enabled or allowed to fall, as is described in more detail below. When the gate 13 is in the upright position, it closes the starting position 16, such that a racer cannot ride forward out of the starting position 16; it prevents the racer from starting. Conversely, when the gate 13 is in the collapsed position, it opens the starting position 16, such that a racer can ride forward out of the starting position 16; it allows the race to start.

Still referring to FIG. 2A, the gates 13 are spaced apart along the common bar 14. The pivoted second ends 42 are proximate the common bar 14, and the first side 43 of one gate 13 is laterally spaced apart from the second side 44 of an adjacent gate 13 in a direction parallel to the length of the common bar 14. When the gates 13 are in the upright positions, this defines gaps 50 between the gates 13. The gaps 50 are openings between the gates 13 through which a racer could pass if he had to avoid falling, though he would likely be penalized or disqualified for doing so.

Downstream from the common bar 14, there is a series of alternating recesses 51 and deck plates 52. The recesses 51 are registered with the gates 13, and the deck plates 52 are registered with the gaps 50. The deck plates 52 are laterally spaced apart from each other above the framework 11, thereby defining the recesses 51 between the deck plates 52.

The deck plates 52 are extensions of the starting deck 12, downstream of the common bar 14. The deck plates 52 are each identical in structure and differ only in location across the gate assembly 10. As such, only one deck plate 52 is described, with the understanding that the description applies equally to all deck plates 52. The deck plate 52 overlies a portion of the framework 11 downstream from the common bar 14. Each deck plate 52 is preferably a single, continuous platform which is capable of supporting racers who veer around the gates 13. Fasteners secure the deck plates 52 to the underlying framework 11. The fasteners are not shown in FIG. 2A, but are preferably bolts, screws, nails, and like fasteners. The deck plate 52 has a downstream end 53 which overlies the front frame element 20, and an upstream end 54 which is just downstream of the common bar 14, spaced apart therefrom. In embodiments, the deck plate 52 is plywood, sheet metal, thick plastic grating, or a like strong, flat material or combination of materials suitable for supporting racers. In embodiments in which the deck plates 52 are smooth, the upper surfaces are preferably treated or applied with a non-slip, high grip texture, such as grip tape or the like.

The deck plates 52 are flanked on either side by rigid frame elements 55. The frame elements 55 are preferably constructed from aluminum or steel square tube or the like and are welded onto the front frame and lateral spar elements 20 and 24 of the framework 11. The frame elements 55 overlie the front frame and lateral spar elements 20 and 24.

Bumpers 56 flank the frame elements 55. The bumpers 56 are elongate and coextensive to the frame elements 55. The bumpers 56 are disposed between the frame elements 55 and the recesses 51 into which the gates 13 collapse when they are in the second position. The bumpers 56 aid in settling the gates 13 when they collapse, in preventing the gates 13 from bouncing back up after collapsing, and in preventing vibration of the framework 11 and gate assembly 10.

The recesses 51 are disposed between the deck plates 52. Each recess 51 is identical in structure and differs only in location, and so one recess 51 is described, with the understanding that the description applies equally to all recesses 51. The recesses 51 are voids in the upper surface defined by the starting deck 12 and the several deck plates 52. In the collapsed position of the gates 13, the gates 13 settle into the recesses 51 and the topside 48 of each gate 13 is flush and level with the upper surfaces of the deck plates 52, the frame elements 55, the bumpers 56, and the starting deck 12.

The recess 51 is rectangular, defined between the parallel bumpers 56, the front frame element 20, and the common bar 14. The recess 51 is sized and shaped to closely receive the gate 13. The recess 51 is open on its top and bottom, such that an item smaller than the recess 51 will fall through. The lateral spar element 24 extends laterally under the recess 51 just downstream from the common bar 14, from one bumper 56 to the adjacent bumper 56. The bumpers 56 and the frame elements 55 are elevated with respect to the framework 11 structure of the front frame element 20 and the lateral spar element 24, such that when the gate 13 collapses, it rests on the frame element 20 and the lateral spar element 24, and its topside 48 is level with the tops of the bumpers 56 and the frame elements 55.

The gates 13 are allowed to collapse into the recesses 51. Referring still to FIGS. 2A and 2B but also to FIGS. 3A and 3B, mechanisms for enabling and disabling movement of the gates 13 are shown. As noted above, the gates 13 are mounted on the common bar 14 for free pivotal movement with respect to the common bar 14. The common bar 14 is a cylindrical bar extending laterally across the entire gate assembly 10, from one side frame element 22 to the other side frame element 22. The common bar 14 is unitary and rigid, resisting twisting, torquing, and other yielding or deforming movements. It defines a pivot axis for each of the gates 13.

The common bar 14 is carried for free rotational movement with respect to the framework 11. As can be seen in the drawings, the framework 11 includes several collars 60 holding the common bar 14. These collars 60 are short cylindrical rings integrally formed or fixed to the framework 11. Preferably, the collars 60 are formed at least partially into the longitudinal spar elements of the framework 11. The common bar 14 extends through each collar 60 and is carried therein for rotation. In embodiments, the collars 60 carry bearings, bearing hubs, or other assemblies which reduce friction between the collars 60 and the common bar 14, such that the common bar 14 freely rotates within each collar 60.

The actuator 15 controls the movement of the common bar 14. In the embodiment shown in these drawings, the actuator 15 is carried near the middle of the gate assembly 10, between the two sides. In other embodiments, it may be disposed in another location. The actuator 15 is supported in a frame 61 which is on top of the starting deck 12. The frame 61 includes a base 62 having two longitudinal frame elements 63 extending forwardly from the upstream end of the frame 61 along the starting deck 12 to the downstream end 31 of the starting deck 12, where the frame elements 63 both drop within the framework 11 and are secured thereto in spaced-apart fashion to define a receiving space 64. A backstop 65 projects upwardly from an upstream end of the base 62 and terminates at a pivot point 66, elevated above the starting deck 12.

The actuator 15 includes a cylinder or housing 70 and a rod 71 mounted within the housing 70 for reciprocal movement. In some embodiments, the actuator 15 is pneumatic, while in others it is hydraulic or a solenoid. The rear end of the housing 70 includes a pivot 72 coupled to the pivot point 66 of the frame 61, so that the back of the actuator 15 can pivot when the rod 71 moves in and out of the housing 70. The rod 71 terminates in a yoke 73 which is pivotally coupled to a bracket 74 mounted near the top of a lever arm 75. That lever arm 75 extends upward from and is fixed to the common bar 14. As shown best in the section view of FIG. 3A, the arm 75 is mounted integrally, or unitarily formed, to a clamp 76 secured over the common bar 14. In other embodiments, the arm 75 is welded or otherwise fixed to the common bar 14.

Energization of the actuator 15 moves the rod 71 with respect to the housing 70 along the double-arrowed line 77, which imparts pivotal movement of the arm 75 about a longitudinal central axis 79 of the common bar 14 along the double-arrowed arcuate line 78. The actuator 15 moves between and among: 1) a retracted position, shown in FIGS. 1A, 2A, and 3A, and corresponding to a raised position of the arm 75; and 2) an extended position, shown in FIGS. 1B, 2B, and 3B, and corresponding to a lowered position of the arm 75. In the lowered position of the arm 75, the arm 75 is disposed in the receiving space 64 between the spaced-apart longitudinal frame elements 63 of the frame 61. The arm 75 moves approximately eighty to one hundred degrees between the raised and lowered positions. This is range of movement is not limiting; in other embodiments of the arm 75, the arm 75 moves through smaller and larger ranges of movement.

Movement of the arm 75 imparts movement to the common bar 14. Because the arm 75 is integrally mounted to a clamp 76, pivotal movement of the arm 75 moves the common bar 14. As the arm 75 pivots forwardly in a downstream direction along the arrowed line 78, the common bar 14 rotates in that same direction. When the arm 75 pivots rearwardly in an upstream direction along the arrowed line 78, the common bar 14 rotates in that same direction. As such, pivotal movement of the arm 75 imparts rotational movement to the common bar 14. The common bar 14 moves between a first condition or first position and a second condition or second position.

Figure 3A:
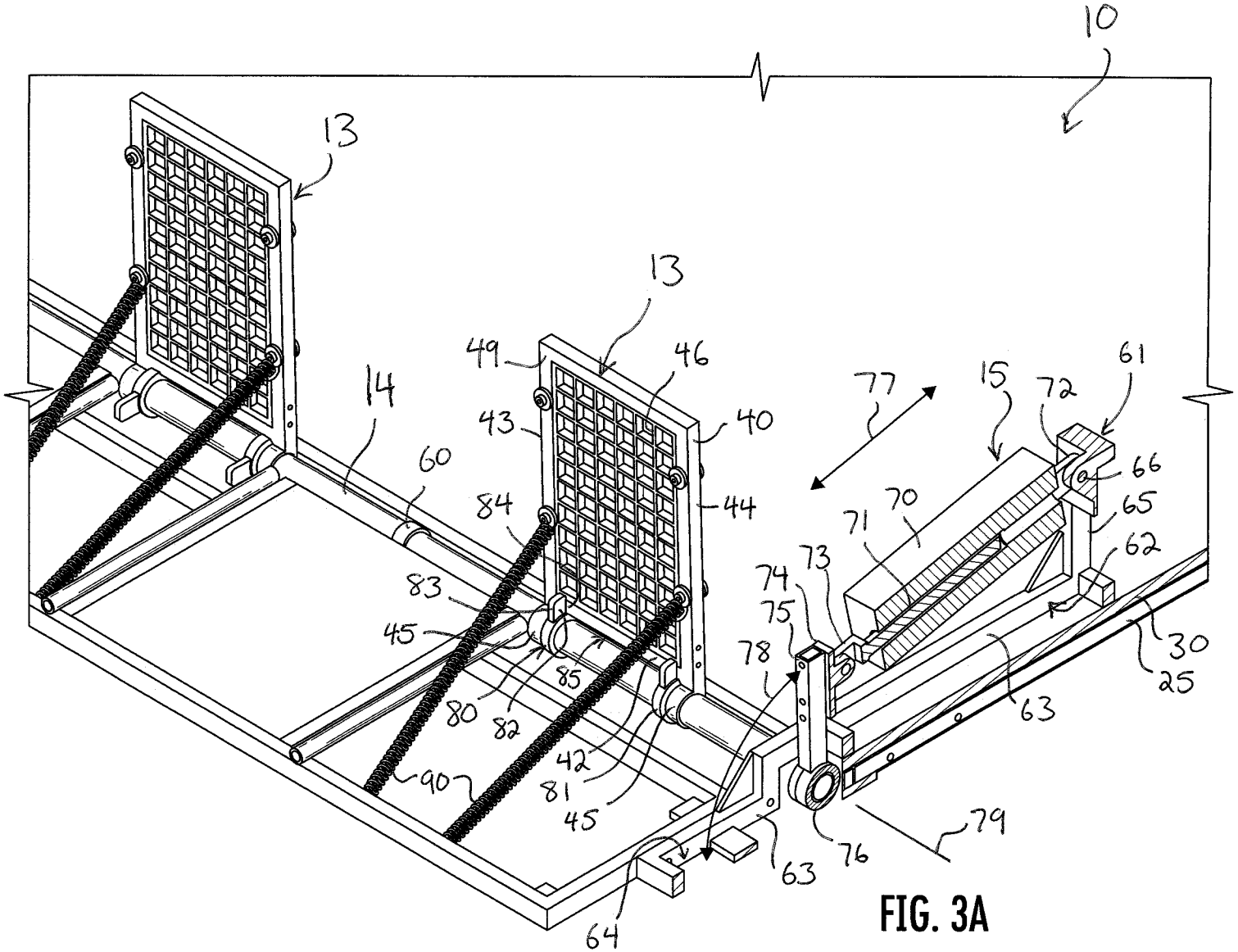
FIGS. 3A and 3B are enlarged perspective section views taken along the line 3-3 in FIG. 2A, showing an actuator moving from a retracted position to an extended position to move buttresses on a common bar, thereby enabling a gate to move from the raised position to the collapsed position.
Figure 3B:
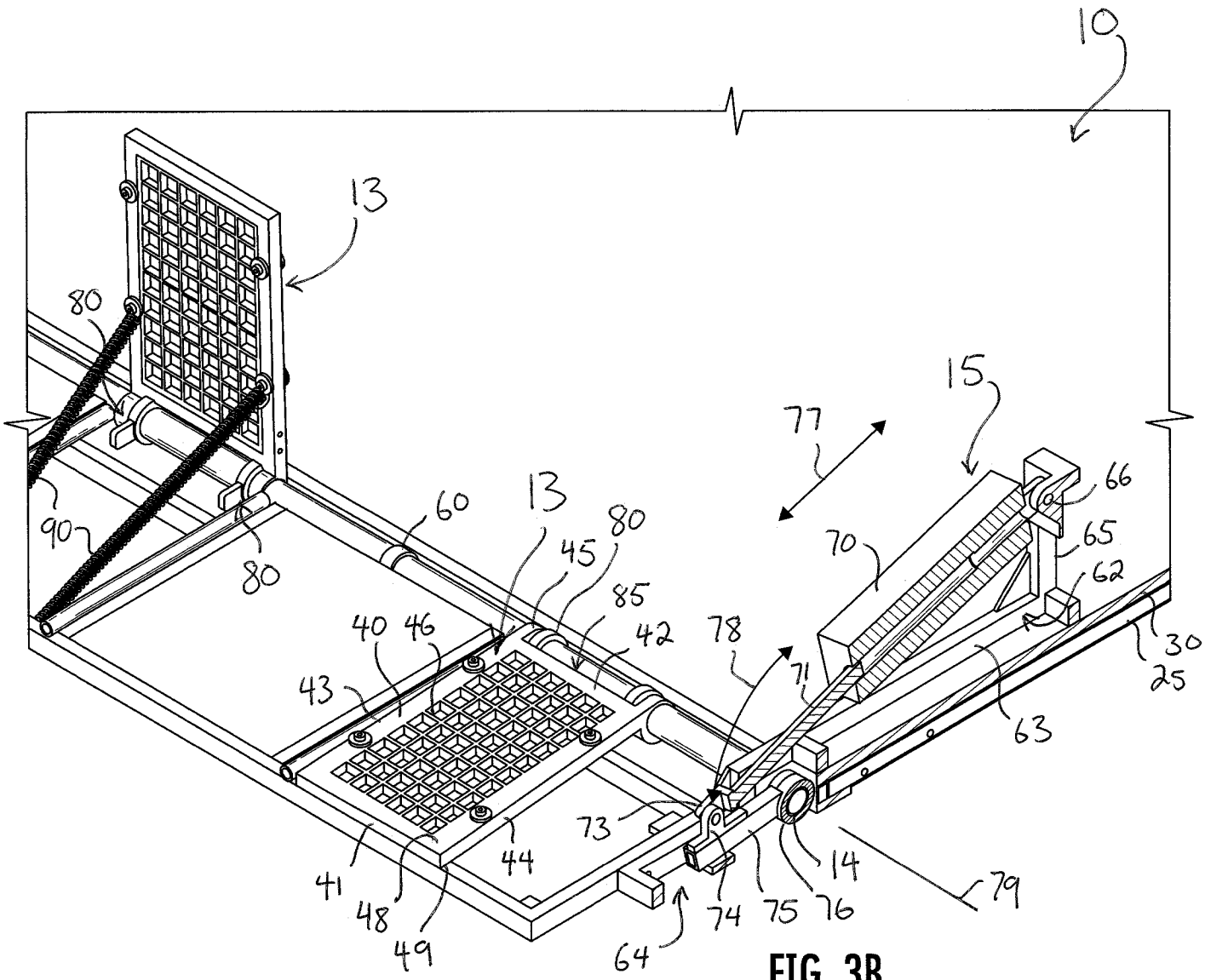

Movement of the common bar 14 enables and disables movement of the gates 13. Buttresses 80 coupled to the common bar 14 control this enablement and disablement. The buttresses 80 are best seen in FIGS. 3A and 3B. The buttresses 80 are stop means with respect to the gates 13. The buttresses 80 are identical in structure and differ only in location across the common bar 14. As such, only one buttress 80 is described, with the understanding that the description applies equally to all buttresses 80. The buttress 80 includes a base ring 81 which is fit over the common bar 14 and secured thereto. In embodiments, the base ring 81 is snug fit and epoxied onto the common bar 14. In other embodiments, the base ring 81 is a two-piece assembly which is clamped onto the common bar 14. In other embodiments, the base ring 81 is a severed or split ring which can be tightened to decrease its diameter to tighten onto the common bar 14. In other embodiments, the base ring 81 includes a set screw to be driven through the base ring 81 into confrontation with the common bar to be held securely with respect thereto. The buttresses 80 are secured to the common bar 14 such that each buttress 80 moves simultaneously and in corresponding rotational movement with the rotational movement of the common bar 14, both between first and second positions of the buttresses 80 corresponding to the first and second positions of the common bar 14.

A short arm projects radially outward from the base ring 81, defining a peg 82. The peg 82 is preferably formed integrally and monolithically to the base ring 81. In the embodiment shown here, the peg 82 has a height extending radially away from the base ring 81 which is approximately half of the diameter of the base ring 81, though this height is not limiting, and other heights are suitable. The peg 82 has a downstream face 83 and an opposed upstream confrontation face 84. The confrontation face 84 is directed toward the gate 13 and receives the underside 49 of the gate 13 under some conditions.

Each gate 13 corresponds to two buttresses 80. Both buttress 80 are mounted over the common bar 14 for rotational movement therewith. The buttresses 80 are preferably within the rings 45 of the gate 13. In other words, each gate 13 has two rings 45 which are generally aligned with the first and second sides 43 and 44 of the gate 13, and one buttress 80 is next to each ring 45, but inboard of the rings 45, so that the first and second sides 43 and 44 are wider than the placement of the two buttresses 80. The buttresses 80 are preferably but not necessarily spaced slightly apart from the rings 45 to prevent friction between the base rings 81 and the rings 45 of the gate 13.

The second end 42 of the gate 13—the upstream or pivoted end—is spaced apart from the common bar 14 by a gap 85, and the base rings 81 occupy a radial portion of that gap 85. This allows the base rings 81 to be mounted within the lateral space on the common bar 14 occupied by a gate 13. The peg 82, however, projects radially away from the base ring 81, beyond the gap 85, and at least partially over the second end 42 of the gate 13. Preferably, and as shown in these drawings, the peg 82 projects the full width of the second end 42. In other words, peg 82 projects to decking 46. In other embodiments, the peg 82 projects further than the width of the second end 42 and projects over at least a portion of the decking 46 within the frame 40 of the gate 13. The confrontation face 84 confronts that second end 42 of the frame 40.

When the actuator 15 energizes and the rod 71 reciprocates out to the extended position, the arm 75 moves into the lowered position, and the common bar 14 rotates to its second position. The buttresses 80, securely coupled to the common bar 14, also move to their second positions. When the buttresses 80 move from the first position to the second position, the confrontation faces 84 move down so that they would otherwise no longer be in contact or confrontation with the underside 49 of the gate 13 if not for forces from upstream racers or downstream springs 90. As such, there is nothing preventing the gate 13 from falling forward toward its collapsed position. If a force is applied to the gate 13 in the downstream direction, the gate 13 will fall in that direction, because no other part of the gate assembly 10 prevents it from doing so. As such, they exert no force against the gate 13, and movement of the buttresses 80 into the second positions enables movement of the gate 13 from the upright position to the collapsed position. For example, if a racer is behind (upstream from) the gate 13, bearing down on the gate 13 as he is about to launch with the start of the race, his weight pushes the gate 13 down against the buttresses 80. Thus, when the actuator 15 energizes at the start of the race, the buttresses 80 move away from confronting the gate 13, allowing the racer to push the gate 13 down and roll over it.

In some embodiments, as shown in FIGS. 2A and 3A, the gates are equipped with springs 90. The springs 90 are longitudinal extension springs and are coupled between rings on the underside 49 of the gate 13 and the front frame element 20 of the framework 11. The springs 90 bias the gate 13 toward the collapsed position and thus assist in snapping the gates 13 down slightly faster than is achieved when the buttresses 80 simply move the pegs 82 out of the way for the racer to push the gates 13 down. The springs 90 are not critical for operation, however.

The buttresses 80 are all mounted to the common bar 14 in the same circumferential position on the common bar 14, and they all move at the same speed. The buttresses 80 therefore enable each gate 13 to fall at the same rate. When forces press the gates 13 against the confrontation faces 84 of the buttresses 80, the gates 13 maintain contact with the buttresses 80, and the buttresses 80 control the rate of collapse of the gates 13. As such, all gates 13 fall at an equal rate through their entire range of motion, thereby ensuring a fair start for the racers across all starting positions 16.

After the start has occurred and the racers have cleared the gate assembly 10, the gate assembly 10 can be returned to its starting position. The actuator 15 moves back into the retracted position, with the rod 71 within the housing 70. This causes the common bar 14 to rotate back in an upstream direction and the buttresses 80 to rotate with it. When the buttresses 80 move back up, the confrontation faces 84 of the pegs 82 contact the undersides 49 of the gates 13 and raise the gates 13. When the actuator 15 is fully moved into the retracted position, the buttresses 80 are oriented such that their pegs 82 are pointed generally up, and the gates 13 are returned to their upright positions.

In this arrangement, the gates 13 block forward movement of any racers who may line up for the next start. The buttresses 80 disable movement of the gates 13 from the upright position to the collapsed position; abutting contact between the confrontation faces 84 of the pegs 82 and the undersides 49 of the gates 13 prevents the gates 13 from moving downstream.

During a start, if a racer first falls over the gate 13 just before the actuator 15 energizes at the start of the race, the gate 13 will not crush the racer even though the actuator 15 quickly moves forward. Rather, as shown in FIG. 3B, only some of the gates 13 fall into the collapsed position. In FIG. 3B, the gate 13 proximate the actuator 15 is enabled to collapse. The racer in the starting position behind that gate 13 launches forward.

However, for the sake of this example, the racer has fallen onto the downstream side of the gate 13 on the left of the drawing. Even though the actuator 15 is in the extended position so as to rotate the common bar 14 into the second position, the gate 13 has not collapsed. The buttresses 80 are rotated into the second position and enable collapse of the gate 13, but so long as there is an obstruction—the racer's body—downstream of the gate 13, the gate 13 will not collapse onto that obstruction with harmful force.

Figure 4:
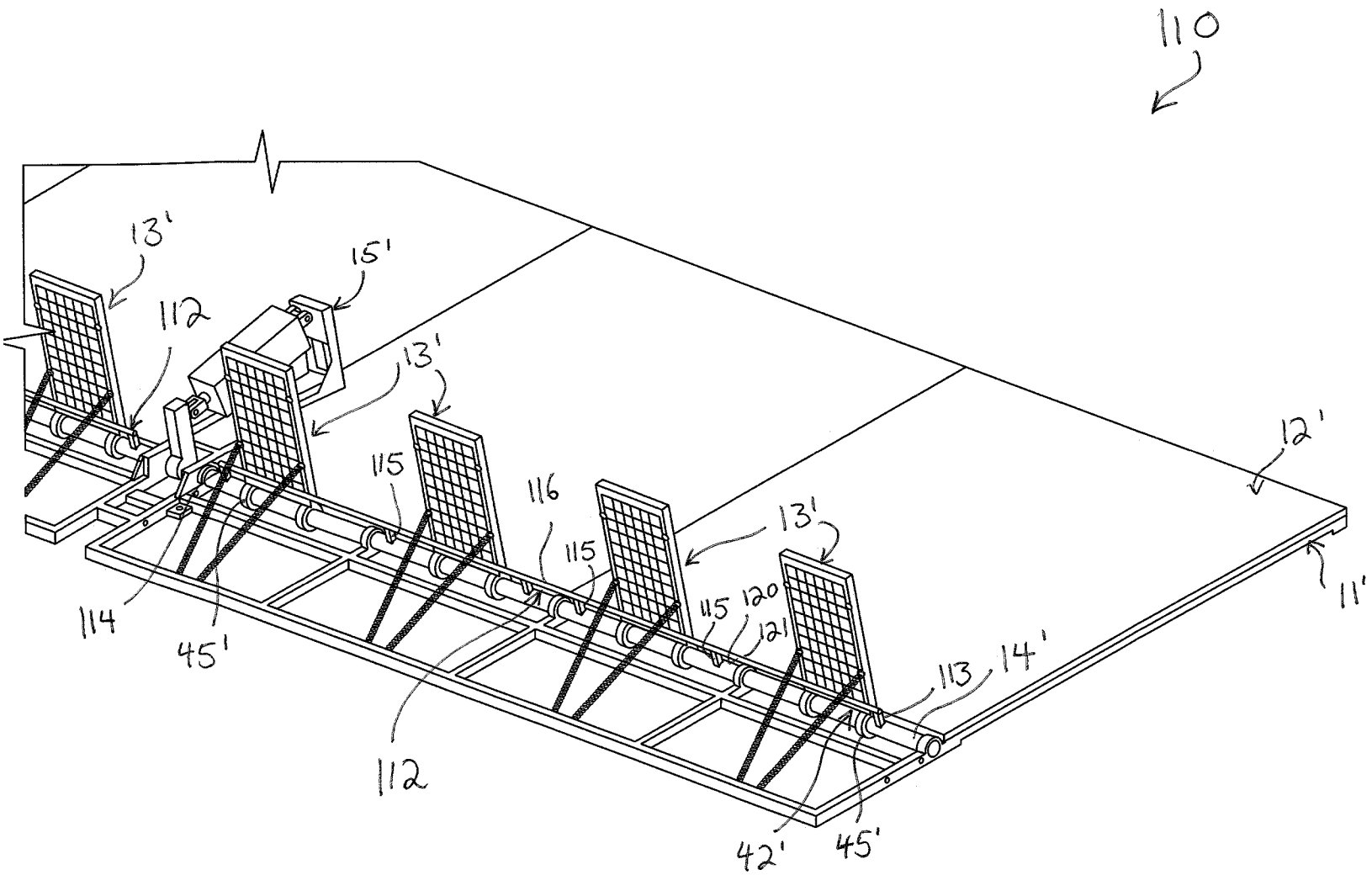
FIG. 4 is a perspective view of an embodiment of a race start gate assembly including a plurality of gates mounted for movement between raised positions and collapsed positions.

In the embodiment shown in FIG. 3B, the gate assembly 10 uses springs 90 to move the gate 13 down into the collapsed position. Though those springs 90 exert some downward force, they are not so taut as to cause injury to a person caught under the gate 13. And in embodiments that do not use springs 90, the gate 13 will not collapse with any appreciable force at all. This protects the racers from injury. FIG. 4 shows an alternate embodiment of a gate assembly 110. The gate assembly 110 is similar to the gate assembly 10 in many respects. For that reason, this specification does not repeat the descriptions of identical structural elements and features, but instead marks them with a prime ("") symbol indicating that those structural elements and features belong to the gate assembly 110 but are otherwise identical to corresponding structural elements and features of the gate assembly 10. For example, the gate assembly 110 includes the same framework 11', the same starting deck 12', and the same gates 13' coupled to a common bar 14' controlled by an actuator 15'. Movement of the common bar 14' enables and disables movement of the gates 13' differently than in the gate assembly 10, however.

Buttresses 112 are coupled to the common bar 14' to enable and disable movement of the gates 13'. The buttresses 112 are stop means with respect to the gates 13'. The gate assembly 110 preferably includes two buttresses 112: one to the right of the actuator 15' and one to the left. The entire length of the buttress 112 to the racer's left is shown in FIG. 4, and the specification refers to this buttress 112 with the understanding that the description applies equally to the other buttress 112.

The buttress 112 includes opposed end posts 113 and 114 projecting radially outward from the common bar 14'. The end posts 113 and 114 are preferably integrally and monolithically formed to the common bar 14'. The posts 113 and 114 project to a height roughly equivalent to the width of the second end 42' of the frame 40' of the gate 13'. Between each gate 13', a supporting post 115 also projects radially outward from the common bar 14'. Like the end posts 113 and 114, the supporting post 115 is also preferably integrally and monolithically formed to the common bar 14' and also projects to a height roughly equivalent to the width of the second end 42'.

The end posts 113 and 114 and the supporting posts 115 are registered and aligned with each other. They each extend to a common or coextensive height away from the common bar 14'.

The ends posts 113 and 114 and the supporting posts 115 all support a common brace 116, which is also part of the buttress 112. The brace 116 is long and preferably constructed from an aluminum or steel square tube or the like. The brace 116 extends entirely between the ends posts 113 and 114, and the post 113, 114, and 115 are preferably formed integrally to the brace 116. The brace 116 is strong, durable, and rigid.

The brace 116 has a downstream face 120 and an upstream confrontation face 121. The confrontation face 121 points toward the gates 13' and receives the underside 49' of each of the gates 13' under some conditions. The brace 116 extends by and among all of the gates 13'. The end posts 113 and 114 are preferably outside of the outer rings 45' of the outside gates 13'. The confrontation face 121 receives in direct contact the underside 49' of each of the gates 13' when the gates 13' are against the buttress 112. The end posts 113 and 114 and the support posts 115 are preferably but not necessarily spaced slightly apart from the rings 45' to prevent friction between the rings 45' and the posts 113, 114, and 115.

When the actuator 15' energizes and the rod 71' reciprocates out to the extended position, the arm 75' moves into the lower position, and the common bar 14' rotates to its second position. The buttress 112, securely coupled to the common bar 14', moves to its second position. When the buttress 112 moves from the first position to the second position, the confrontation face 121 would otherwise no longer be in contact or confrontation with the undersides 49' of the gates 13' but for the forces acting on it by upstream racers and/or downstream springs 90'. As such, there is nothing preventing the gates 13' from falling forward toward their collapsed position. If a force is applied to the gates 13' in the downstream direction, the gates 13' will fall in that direction, because no other part of the gate assembly 10 is preventing them from doing so. As such, movement of the buttress 112 into the second position enables movement of the gate 13' from the upright position to the collapsed position. For example, if a racer is behind (upstream of) the gate 13' in a staring position 16, bearing down on the gate 13' as he is about to launch with the start of the race, his weight would push the gate 13' down. Thus, when the actuator 15' energizes at the start of the race, the buttress 112 moves away from confronting the gates 13', allowing the racers to push the gates 13' down and roll over them.

In some embodiments, as shown here in FIG. 4, the gates 13' are equipped with springs 90'. The springs 90' are longitudinal extension springs and are coupled between the rings on the undersides 49' of the gates 13' and the front frame element 20' of the framework 11'. The springs 90' bias the gates 13' toward the collapsed position and thus assist in snapping the gates 13' down slightly faster than is achieved when the buttress 112 simply moves the brace 116 out of the way for the racers to push the gates 13' down. The springs 90' are not critical for operation, however.

After the start has occurred and the racers have cleared the gate assembly 110, the gate assembly 110 is returned to its starting position. The actuator 15' moves back into the retracted position, with the rod 71' within the housing 80'. This causes the common bar 14' to rotate back in an upstream direction and the buttress 112 to rotate with it. When the buttress 112 moves back up, the confrontation face 121 of the brace 116 contacts the undersides 49' of the gates 13' and raises the gates 13'. When the actuator 15' is fully moved into the retracted position, the buttress 112 is oriented such that the end posts 113 and 114 and the supporting posts 115 are pointed generally up, and the gates 13' are returned to their upright positions.

In this arrangement, the gates 13' block forward movement of any racers who may line up for a start. The buttress 112 disables movement of the gates 13' from the upright position to the collapsed position; abutting contact between the confrontation face 121 of the brace 116 and the undersides 49' of the gates 13' prevents the gates 13 from moving downstream.

During a start, if a racer first falls over one of the gates 13' just before the actuator 15' energizes at the start of the race, that gate 13' will not crush the racer even though the actuator 15' quickly moves forward. Rather, only some of the gates 13' will fall into the collapsed position. The racers in starting positions 16 behind those gates 13 that did properly collapse can launch forward.

A racer who has fallen onto the downstream side of one of the gates 13' cannot start, but he also will not be crushed. Even though the actuator 15' is in the extended position so as to rotate the common bar 14' into the second position, the racer's gate 13' will not collapse. The buttress 112 is rotated into the second position and enables collapse of the gate 13', but so long as there is an obstruction—the racer's body—downstream of the racer's gate 13', that gate 13' will not collapse onto that obstruction with harmful force.

Figure 5:
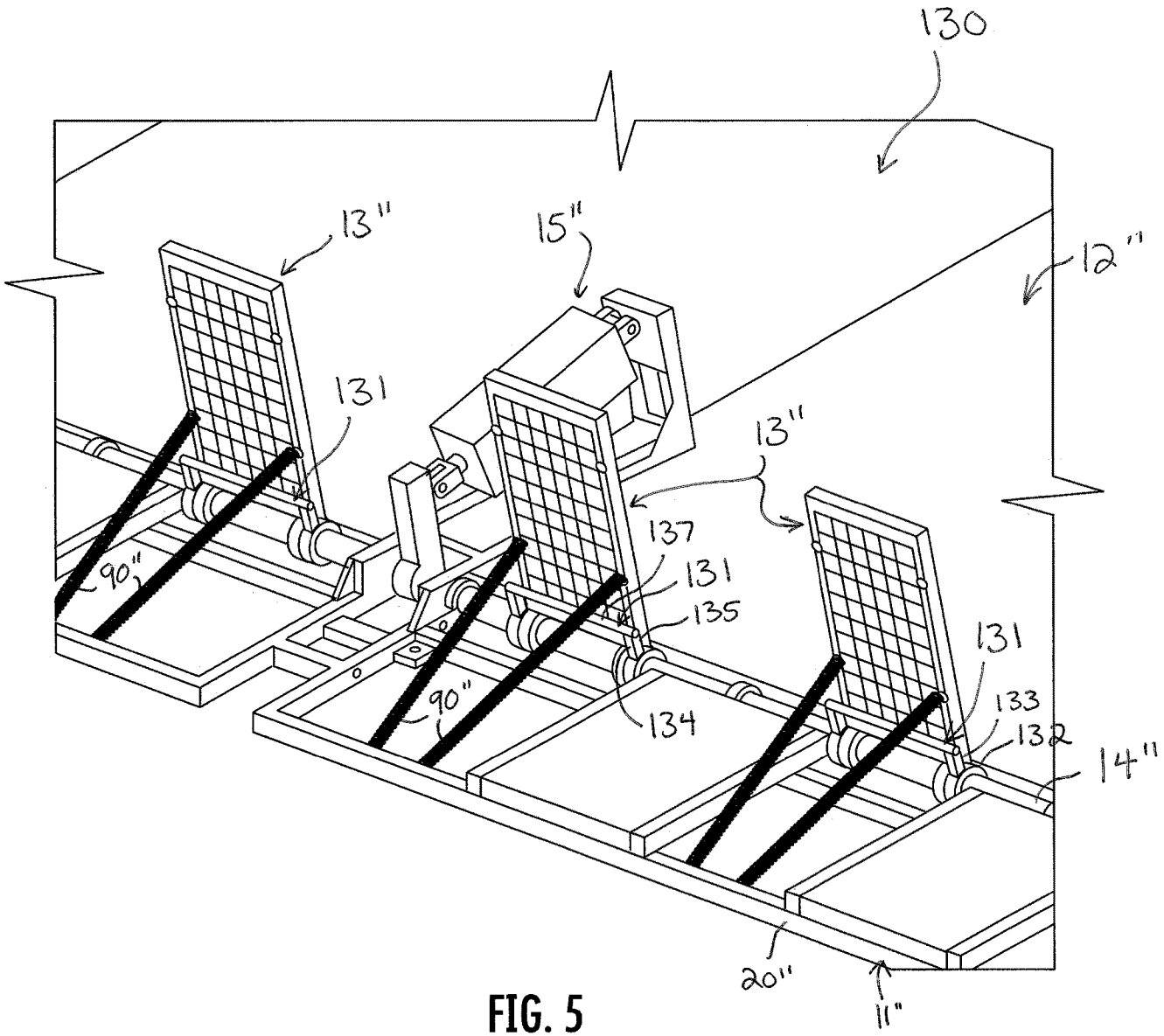
FIG. 5 is an enlarged perspective view of an embodiment of a race start gate assembly including a plurality of gates mounted for movement between raised positions and collapsed positions.

FIG. 5 shows, in enlarged view, another alternate embodiment of a gate assembly 130. The gate assembly 130 is similar to the gate assemblies 10 and 110 in many respects. For that reason, this specification does not repeat the descriptions of identical structural elements and features, but instead marks them with a double-prime ("") symbol indicating that those structural elements and features belong to the gate assembly 130 but are otherwise identical to corresponding structural elements and features of the gate assembly 10. For example, the gate assembly 130 includes the same framework 11", the same starting deck 12", and the same gates 13" coupled to a common bar 14" controlled by an actuator 15".

Movement of the common bar 14" enables and disables movement of the gates 13" differently than in the gate assembly 10, however. Buttresses 131 are coupled to the common bar 14" that control this enablement and disablement. The buttresses 131 are stop means with respect to the gates 13". The buttresses 131 are identical in structure and differ only in location across the common bar 14". As such, only one buttress 131 is described, with the understanding that the description applies equally to all buttresses 131.

The buttress 131 includes two base rings 132 which fit over the common bar 14" and secure thereto. In embodiments, the base ring 132 is snug fit and adhered, epoxied, welded, or otherwise fixed onto the common bar 14". In other embodiments, the base ring 132 is a two-piece assembly which is clamped onto the common bar 14". In other embodiments, the base ring 132 is a severed or split ring which can be tightened to decrease its diameter to tighten onto the common bar 14". In other embodiments, the base ring 132 includes a set screw to be driven through the base ring 132 into confrontation with the common bar to be held securely with respect thereto. The buttress 131 is secured to the common bar 14" such that each buttress 131 moves simultaneously and in corresponding rotational movement with the rotational movement of the common bar 14", both between first and second positions.

A short arm projects radially outward from each base ring 132, defining a post 133. Each post 133 is preferably formed integrally and monolithically to the base ring 132. In the embodiment shown here, the post 133 has a height extending radially away from the base ring 132 which is approximately half of the diameter of the base ring 132, though this height is not limiting; other heights are suitable. The post 133 has a downstream face 134 and an opposed upstream confrontation face 135. The confrontation face 135 is directed toward the gate 13" and receives the underside 49" of the gate 13" under some conditions.

The base rings 132 are spaced apart laterally on the common bar 14". A common brace 136 extends between adjacent posts 133 on the spaced-apart base rings 132, under each gate 13". Each brace 136 extends between preferably only two adjacent posts 133 under a gate 13". In other words, for each gate 13", there is one buttress 131 including two base rings 132, two posts 133, and a brace 136 extending between the two posts 133.

The brace 136 is long and preferably constructed from an aluminum or steel square tube or the like. The posts 133 are preferably formed integrally to the brace 116. The brace 136 is strong, durable, and rigid.

The brace 136 has an upstream confrontation face 137. The confrontation face 137 points toward its respective gate 13" and receives the underside 49" of that gate 13" in some conditions. For each buttress, the base rings 132 are preferably outboard of—or outside of—the gate 13", and the posts 133 are preferably outside of outside rings 45" of the gate 13". The confrontation face 137 of the brace 136 receives in direct contact the underside 49" of the gate 13" when the gate 13" is against the buttress 131. The posts 133 are preferably, but not necessarily, spaced slightly apart from the rings 45" to prevent friction between the rings 45" and the posts 133.

When the actuator 15" energizes and the rod 71" reciprocates out to the extended position, the arm 75" moves into the lower position, and the common bar 14" rotates to its second position. The buttresses 131, securely coupled to the common bar 14", move to their second positions. When the buttresses 131 move from the first positions to the second positions, the confrontation faces 137 are no longer in contact or confrontation with the undersides 49" of the gates 13". As such, there is nothing preventing the gates 13" from falling forward toward its collapsed position. Each gate 13" is thus enabled to collapse.

If a force is applied to any gate 13" in the downstream direction when the common bar 14" and buttresses 131 are in the second positions, the gate 13" will fall in that direction, because no other part of the gate assembly 130 is preventing it from doing so. As such, movement of the buttresses 131 into the second positions enable movement of the gate 13" from the upright position to the collapsed position. For example, if a racer is behind (upstream from) a particular gate 13", bearing down on the gate 13" as he is about to launch with the start of the race, his weight would push the gate 13" down. Thus, when the actuator 15" energizes at the start of the race, the buttresses 131 move away from confronting the gate 13", allowing the racers to push the gates 13" down and roll over them.

In some embodiments, as shown here in FIG. 5, the gates 13" are equipped with springs 90". The springs 90" are longitudinal extension springs and are coupled between the rings on the undersides 49" of the gates 13" and the front frame element 20" of the framework 11". The springs 90" bias the gates 13" toward the collapsed position and thus assist in snapping the gates 13" down slightly faster than is achieved when the buttress 131 simply moves the brace 136 out of the way for the racers to push the gates 13" down. The springs 90" are not critical for operation, however.

After the start has occurred and the racers have cleared the gate assembly 130, the gate assembly 130 returns to its starting position. The actuator 15" moves back into the retracted position, with the rod 71" within the housing 80". This causes the common bar 14" to rotate back in an upstream direction and the buttress 131 to rotate with it. When the buttress 131 moves back up, the confrontation face 137 of the brace 136 contacts the underside 49" of the gate 13" and raises the gate 13". When the actuator 15" is fully moved into the retracted position, the buttress 131 is oriented such that the posts 133 are pointed generally up, and the gates 13" return to their upright positions.

In this arrangement, the gates 13" block forward movement of any racers who may line up for a start. The buttress 131 disables movement of the gates 13" from the upright position to the collapsed position; abutting contact between the confrontation face 137 of the brace 136 and the underside 49" of the gate 13" prevents the gate 13 from moving downstream.

During a start, if a racer first falls over one of the gates 13" just before the actuator 15" energizes at the start of the race, the gate 13" will not crush the racer even though the actuator 15" quickly moves forward. Rather, only some of the gates 13" fall into the collapsed position. The racers in starting positions behind the gates 13" that did properly collapse can launch forward.

A racer who has fallen onto the downstream side of one of the gates 13" cannot start, but he also will not be crushed. Even though the actuator 15" is in the extended position so as to rotate the common bar 14" into the second position, the racer's gate 13" will not collapse. The buttress 131 is rotated into the second position and enables collapse of the gate 13", but so long as there is an obstruction—the racer's body—downstream of the racer's gate 13", that gate 13" will not collapse onto that obstruction with harmful force.

Figure 6:
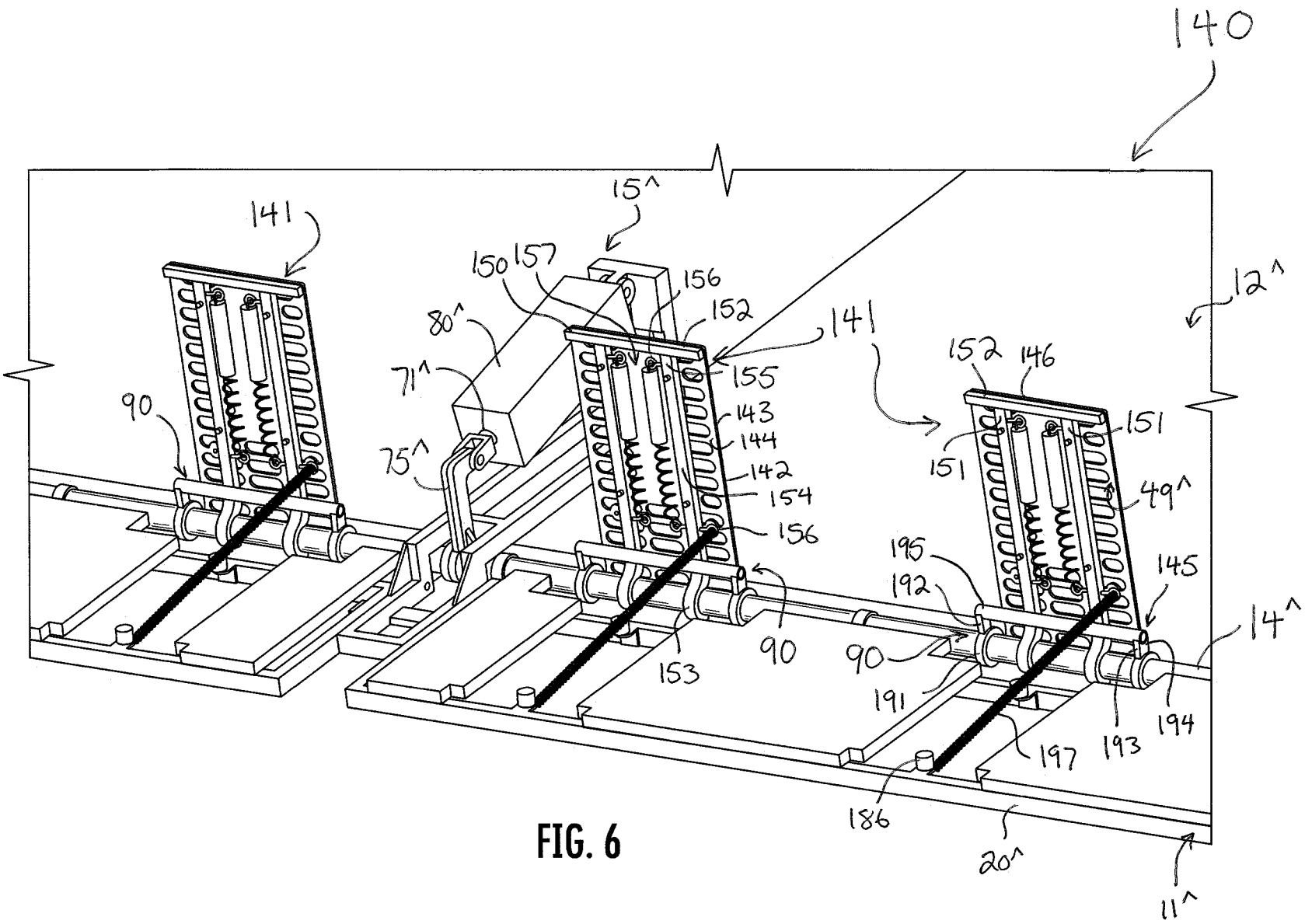
FIG. 6 is an enlarged perspective view of an embodiment of a race start gate assembly including a plurality of gates mounted for movement between raised positions and collapsed positions.

FIG. 6 shows yet another alternate embodiment of a gate assembly 140. The gate assembly 140 is similar to the gate assemblies 10, 110, and 130 in many respects. For that reason, this specification does not repeat the descriptions of identical structural elements and features, but instead marks them with a caret ("^") symbol indicating that those structural elements and features belong to the gate assembly 140 but are otherwise identical to corresponding structural elements and features of the gate assembly 10. For example, the gate assembly 140 includes the same framework 11^, the same starting deck 12^, and the same common bar 14^ controlled by an actuator 15^.

Figure 7A:
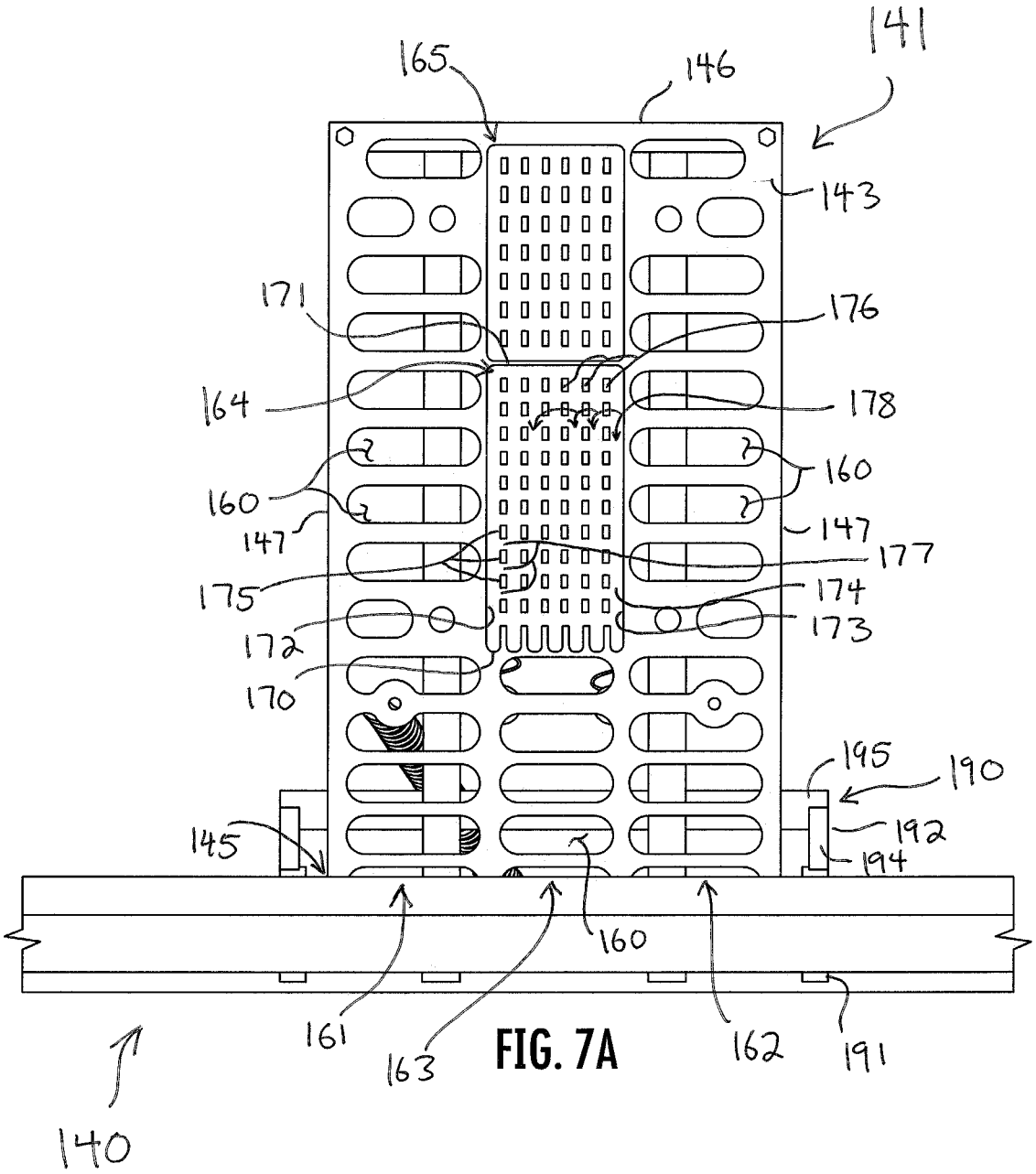
FIG. 7A is an upstream view of a gate of the gate assembly of FIG. 6.
Figure 7B:
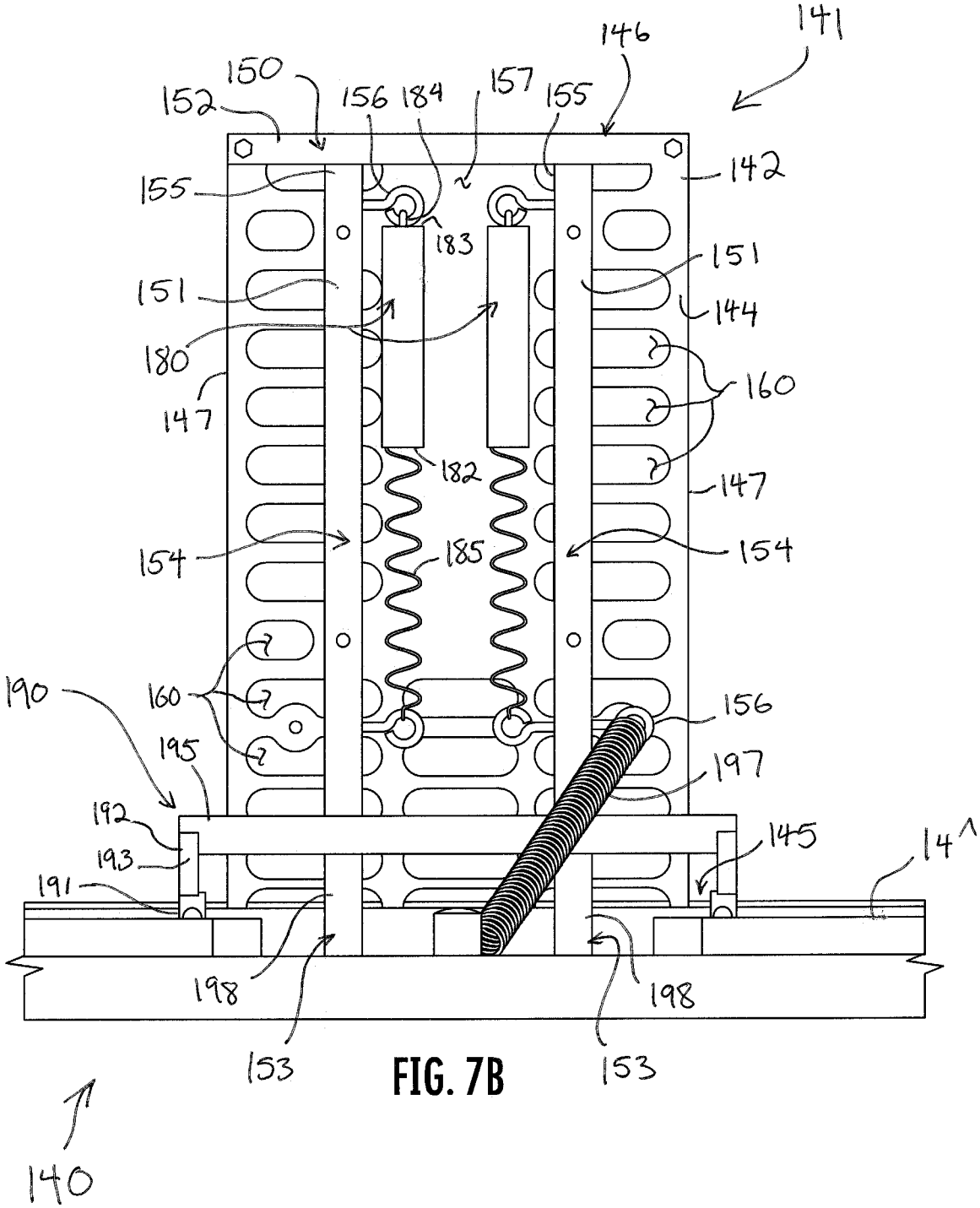
FIG. 7B is a downstream view of a gate of the gate assembly of FIG. 6.
Figure 7C:
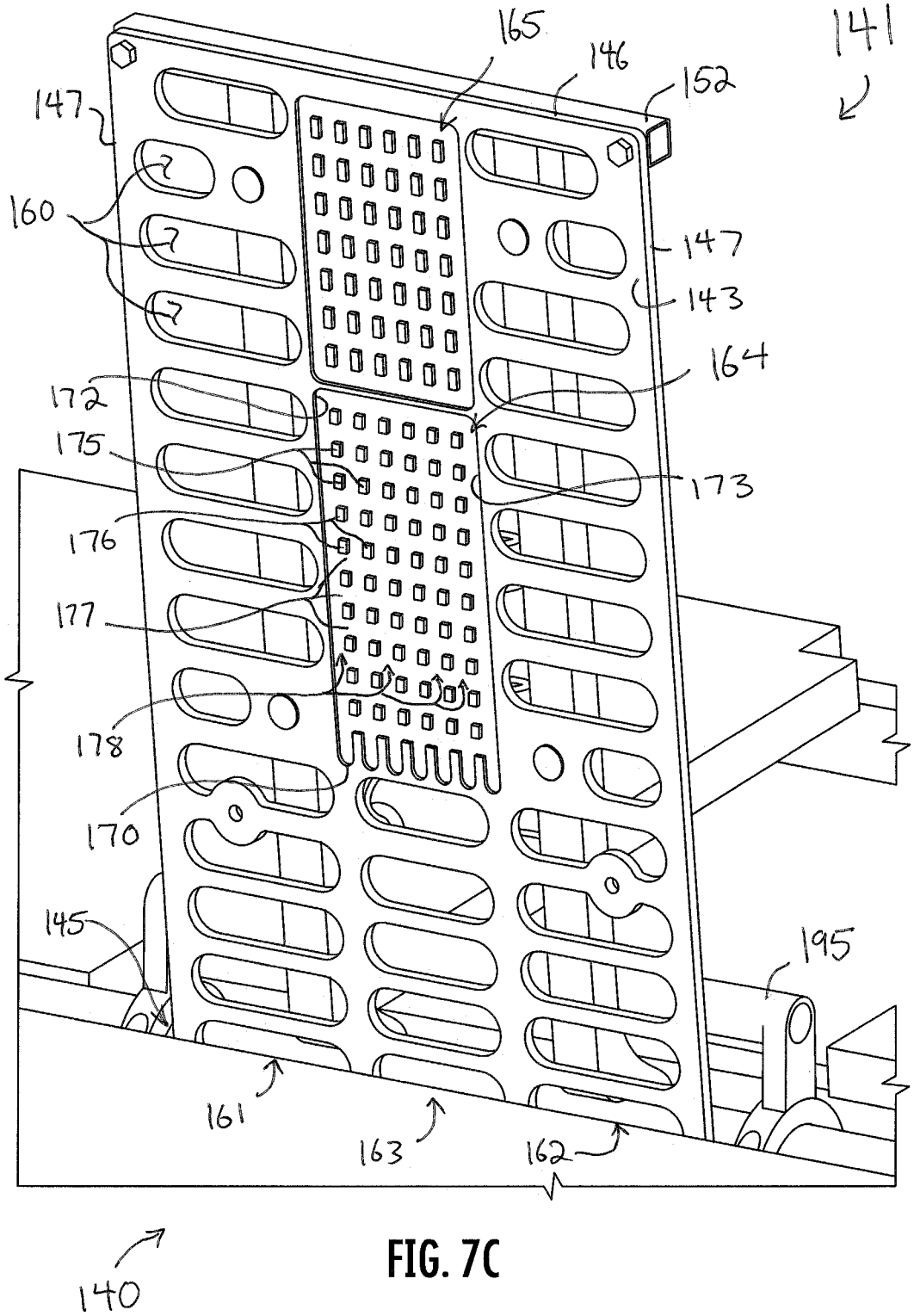
FIG. 7C is an upstream perspective view of a gate of the gate assembly of FIG. 6.

The gate assembly 140 includes gates 141 which are different from the gates of the other gate assemblies. FIG. 6 shows three of the gates 141 installed in the gate assembly 140, and FIGS. 7A and 7B illustrate upstream and downstream views of one of those gates 141. FIG. 7C is a perspective view of the gate 141.

The gates 141 are identical in structure and differ only in location on the gate assembly 140. As such, description herein is made without distinction between the gates 141, since each gate 141 has the same structural elements and features. Thus, this specification uses the same reference characters for all of the gates 141, and the reader will understand that the description applies equally to all gates 141. Some of the reference characters are applied to some of the gates 141 in the drawings, while other reference characters are applied to other gates 141, but the reader will understand that each gate 141 has all the structural elements and features marked by all the reference characters of the gates 13.

The gate 141 includes a plate 142 having opposed upstream and downstream faces 143 and 144. The gate 141 moves between a first or upright position and a second or collapsed position. When the gate 141 is in the collapsed position, the downstream face 144 points downward and is generally concealed, and the upstream face 143 points upward and is available to be ridden over by the racer exiting a starting position 16. Between the upstream and downstream faces 143 and 144, the gate 141 has a thickness. The thickness is preferably constant and consistent across the extent of the gate 141.

The gate 141 is rectangular, having opposed upstream and downstream edges or ends 145 and 146 and opposed sides 147. The upstream and downstream ends 145 and 146 are preferably straight and parallel to each other and are also perpendicular to each of the straight sides 147.

A framework 150 supports the plate 142. The framework 150 includes two longitudinal struts 151 and a lateral brace 152. The struts 151 extend from the upstream end 145 toward the downstream end 146. The brace 152 extends across the downstream end 146 between the opposed sides 147 of the plate 142. The framework 150 increases the rigidity and strength of the plate 142. Both the struts 151 and the brace 152 are preferably constructed from aluminum or steel square tube or the like.

The struts 151 are identical to each other in structure, differing only in location. As such, this specification describes only one of the struts 151 with the understanding that the description applies equally to both struts 151. The strut 151 is a bar which extends from a ring 153 along a straight shank 154 to terminate at a free end 155. The free end 155 is in abutting contact with the brace 152 and is preferably fixed to the brace 152 with fasteners, adhesive, welding, or like fastening methods. The struts 151 and the brace 152 are themselves fixed to the downstream face 144 of the plate 142 with fasteners, adhesive, welding, or like fastening methods.

The rings 153 enable pivotal movement of the strut 151 with respect to the common bar 14^. The common bar 14^ extends across the gate assembly 140, and all of the gates 141 are mounted to the common bar 14^. In the embodiment shown in FIGS. 6-7C, there are actually two common bars 14^ axially registered with each other, one extending to the left of the actuator 15^ and one extending to the right of the actuator 15^.

The ring 153 preferably defines a closed circle and is integrally formed to the shank 154. The ring 153 is mounted over the common bar 14^ for free pivotal movement with respect to the common bar 14^ so that it may spin, rotate, or pivot freely over the common bar 14^. Each gate 141 has two rings 153, and the two rings 153 of each gate 141 are coaxial, have a common inner diameter, and share an axis which is coincident to a central longitudinal axis of the common bar 14^.

In some embodiments, the ring 153 may be open but nonetheless encircles enough of the common bar 14ˆ to enable rotation of the ring 153 around the common bar 14ˆ without falling off the common bar 14ˆ. In other embodiments, the ring 153 is a two-piece assembly which is clamped together over the common bar 14ˆ. In other embodiments, the ring 153 is a severed or split ring which can be tightened as desired over the common bar 14ˆ to allow for rotation. In other embodiments, the ring 153 includes a bushing or bearing hub mounted to the common bar 14ˆ to enable pivotal movement with respect thereto.

Each ring 153 is integrally formed to a strut 151 at the upstream end 145 of the plate 142. The struts 151 are laterally spaced apart from each other under the plate 142. Both struts 151 are inboard of the sides 147 of the plate 142, or are inset from the sides 147 of the plate 142. They are preferably parallel to those sides 147. A lateral gap or receiving space 157 exists between the opposed struts 151 which is constant and consistent from rings 153 to the free ends 155. The struts 151 have threaded holes on their sides, and eyebolts 156 are threadably engaged to those holes. Those eyebolts 156 are attachment points for mass-damper assemblies and springs, as is described below.

The brace 152 extends laterally across the downstream end 146 of the plate 142. The brace 152, on the underside 49ˆ or downstream face 143 of the plate 142, is just inboard of the downstream end 146, so that, as the gate 141 pivots between its first and second positions, the brace 152 does not impede the gate 141 from collapsing into the second position. The brace 152 is preferably parallel to the downstream end 146. The opposing sides 147 of the plate 142 bound the brace 152, such that the opposed ends of the brace 152 are inboard of the sides 147.

Still referring to FIGS. 6-7C, the plate 142 includes a plurality of slots 160. The slots 160 increase traction between each racer's wheel and the plate 142 to assist the racer in propelling the rear wheel forward when riding over a collapsed gate 141. The slots 160 extend entirely through the plate 142 from the upstream face 143 to the downstream face 144. Most of the slots 160 are oblong, extending laterally across the plate 142 oriented between the opposed sides 147 thereof. There are preferably three columns of slots 160: a first column 161 of slots 160 along one side 147, a second column 162 of slots 160 along the opposed side 147, and an intermediate column 163 of slots 160 between the first and second columns 161 and 162.

The slots 160 in the first and second columns 161 and 162 are slightly longer than those in the intermediate column 163. There are also more slots 160 in the first and second columns 161 and 162 than in the intermediate column 163. In the first and second columns 161 and 162, the slots 160 are spaced apart in rows—preferably one slot 160 per row—from the upstream end 145 to the downstream end 146. In the intermediate column 163, there are several slots 160 arranged in spaced-apart rows, but the rows extend from the upstream end 145 only partway toward the downstream end 146. In the embodiment shown in these drawings, there are five slots 160 in the intermediate column 163. Beyond that, the plate 142 is solid.

Beyond the downstream-most slot 160 in the intermediate column 163, there are two tread plates 164 and 165. The tread plates 164 and 165 are best shown in FIGS. 7A and 7C. In some embodiments, there is only a single tread plate, while in other embodiments, there are more than two tread plates 164 and 165. In the embodiment shown here, tread plate 164 is an upstream tread plate as it is closer to the upstream end 145 of the plate 142, and tread plate 165 is a downstream tread plate as it is closer to the downstream end 146 of the plate 142.

The tread plates 164 and 165 are depressions formed into the upstream face 143. In other embodiments, the tread plates 164 and 165 may be placed atop the upstream face 143 such as by welding, adhesive, fasteners, or other fastening methods. The tread plates 164 and 165 here, however, are integrally formed as part of the plate 142 and are merely defined areas of the plate 142 rather than separate pieces fixed thereto.

Referring still to FIGS. 7A and 7C, the tread plate 164 includes an upstream end 170, a downstream end 171, and opposed sides 172 and 173. For orientation purposes only, the side 172 is on the racer's left and the side 173 is on the racer's right. The tread plate 164 has a recessed surface 174 which is recessed into the body of the plate 142, below the upstream face 143. A plurality of projections 175 or bumps project upwardly from the recessed surface 174. In the embodiment shown here, the projections 175 have tops 176 that terminate flush with the upstream face 143. In other embodiments, the tops 176 are above or below the upstream face 143.

In cross-section, parallel to the recessed surface 174, the projections 175 are oblong with a short axis and a transverse long axis. The long axis of each projection 175 is oriented between the upstream and downstream ends 145 and 146 of the plate 142. The projections 175 are arranged in columns and are spaced apart from each other in those columns by gaps 177. The columns of projections 175 are in turn spaced apart from each other by grooves 178. In other words, the grooves 178 are long empty channels between columns of projections 175. The tread plate 164 provides traction to prevent a racer's front wheel from slipping laterally before the start.

The tread plate 165 is identical to the tread plate 164 except that it is slightly shorter. Again, in some embodiments of the gate 141, there is only one tread plate 165 which may be longer or shorter than those shown here, and in other embodiments, there are multiple tread plates 165 of the same or different sizes.

Referring now primarily to FIG. 7B, the underside 49" of the plate 142 carries two mass dampers 180. The mass dampers 180 are identical in every respect except location, and as such, this specification describes only one mass damper 180 with the understanding that the description applies equally to both mass dampers 180.

The mass damper 180 includes a mass or weight 181. The weight 181 has opposed upstream and downstream ends 182 and 183 and an axis extending therebetween. The weight 181 shown here is a cylindrical bar weight and is sized to fit within the receiving space 157 between the struts 151 and under the plate 142. In the embodiment shown here, the weight 181 is a solid bar; in other embodiments, the weight 181 is a collection of weights such as a number of washers strung together.

The weight 181 is fit over an attachment 184. The attachment 184 includes a rod terminating in a hook. The hook is visible in the drawings. The weight 181 can reciprocate over the rod in a direction aligned between the upstream and downstream ends 145 and 146 of the plate 142. The weight 181 can also move away from the underside of the plate 142. These movements counteract the natural bounce back of the gate 141 when it collapses. The hook of the attachment 184 is connected to the eyebolt 156 secured to the strut 151 near the downstream end 146 of the plate. One end of an extension spring 185 is integrally connected to the upstream end 182 of the weight 181. The other end of the extension spring 185 is connected to the eyebolt 156 secured to the strut 151 near the upstream end 145 of the plate. The weight 181 is therefore suspended under the plate 142 and is able to translate between the upstream and downstream ends 145 and 146 of the plate 142 and outwardly away from the underside of the plate 142.

When the gate 141 collapses into the second position, the weight 181 moves toward the upstream end 145 of the plate 142 and also outwardly away from the plate 142, creating momentum which counteracts and mitigates or prevents any tendency of the gate 141 to bounce up out of the second position. A bumper 186 (shown in FIG. 6) located on the front frame element 20ˆ also mitigates bounce.

The common bar 14ˆ enables and disables the gate 141 from collapse. Buttresses 190 are coupled to the common bar 14ˆ that control this enablement and disablement. The buttresses 190 are stop means with respect to the gates 14ˆ. The buttresses 190 are identical in structure and differ only in location across the common bar 14ˆ. As such, only one buttress 190 is described, with the understanding that the description applies equally to all buttresses 190.

The buttress 190 includes two base rings 191 which fit over the common bar 14ˆ and secure thereto. In embodiments, the base ring 191 is snug fit and epoxied, adhered, welded, or otherwise fixed onto the common bar 14ˆ. In other embodiments, the base ring 191 is a two-piece assembly which is clamped onto the common bar 14ˆ. In other embodiments, the base ring 191 is a severed or split ring which can be tightened to decrease its diameter to tighten onto the common bar 14ˆ. In other embodiments, the base ring 191 includes a set screw to be driven through the base ring 191 into confrontation with the common bar 14ˆ to be held securely with respect thereto. The buttresses 190 are secured to the common bar 14ˆ such that each buttress 190 moves simultaneously and in corresponding rotational movement with the rotational movement of the common bar 14ˆ, both between first and second positions.

A short arm projects radially outward from each base ring 191, defining a post 192. Each post 192 is preferably formed integrally and monolithically to the base ring 191. In the embodiment shown in FIGS. 6-7C, the post 192 has a height extending radially away from the base ring 191 which is approximately half of the diameter of the base ring 191, though this height is not limiting; other heights are suitable. The post 192 has a downstream face 193 and an opposed upstream face 194. The upstream face 194 is directed toward the gate 141.

The base rings 191 are spaced apart laterally on the common bar 14ˆ. A common brace 195 extends between adjacent posts 192 on the spaced-apart base rings 191, across the downstream side of each gate 141. Each brace 195 extends between preferably only two adjacent posts 192 under a gate 141. In other words, for each gate 141, there is one buttress 190 including two base rings 191, two posts 192, and a brace 195 extending between the two posts 192.

The brace 195 is long and preferably constructed from an aluminum or steel tube or the like. The posts 192 are preferably formed integrally to the brace 116. The brace 195 is strong, durable, and rigid.

The brace 195 has an upstream confrontation face 196. The confrontation face 196 points toward its respective gate 141 and receives downstream confrontation faces 198 on the downstream side of the struts 151. For each buttress, the posts 192 are outside of the rings 153 of the gate 141. The confrontation face 196 of the brace 195 receives the downstream faces 198 of the struts 151 in direct contact when the gate 141 is against the buttress 190. The posts 192 are spaced apart from the rings 45ˆso that there is no friction between the rings 45ˆ and the posts 192.

When the actuator 15ˆ energizes and the rod 71ˆ reciprocates out to the extended position, the arm 75ˆ moves into the lower position, and the common bar 14ˆ rotates to its second position. The buttresses 190, securely coupled to the common bar 14ˆ, move to their second positions. When the buttresses 190 move from the first position to the second position, the confrontation faces 196 would otherwise no longer be in contact or confrontation with the downstream faces 198 of the struts 151, but for the forces acting on it by upstream racers and/or downstream springs 90ˆ. As such, there is nothing preventing the gates 141 from falling forward toward their collapsed positions. Each gate 141 is thus enabled to collapse.

If a force is applied to any gate 141 in the downstream direction when the common bar 14ˆ and buttresses 190 are in the second positions, the gate 141 will fall in that direction, because no other part of the gate assembly 140 is preventing it from doing so. As such, movement of the buttresses 190 into the second positions enables movement of each gate 141 from the upright position to the collapsed position. For example, if a racer is behind (upstream from) a particular gate 141 in a starting position 16, bearing down on the gate 141 as he is about to launch with the start of the race, his weight would push the gate 141 down. Thus, when the actuator 15ˆ energizes at the start of the race, the buttresses 190 move away from confronting the gate 141, allowing the racers to push the gates 141 down and roll over them.

In some embodiments, as shown here in FIGS. 6 and 7B, the gates 141 are equipped with a spring 197. The spring 197 is a longitudinal extension spring and is coupled between the eyebolts 156 on the undersides 49ˆ of the gates 141 and the front frame element 20ˆ of the framework 11ˆ. The spring 197 assists in snapping the gates 141 down slightly faster than is achieved when the buttress 190 simply moves the brace 195 out of the way for the racers to push the gates 141 down. The spring 197 is not critical for operation, however.

After the start has occurred and the racers have cleared the gate assembly 140, the gate assembly 140 returns to its starting position. The actuator 15ˆ moves back into the retracted position, with the rod 71ˆ within the housing 80ˆ. This causes the common bar 14ˆ to rotate back in an upstream direction and the buttress 190 to rotate with it. When the buttress 190 moves back up, the confrontation face 196 of the brace 195 contacts the downstream faces 198 of the struts 151 and raises the gate 141. When the actuator 15ˆ is fully moved into the retracted position, the buttress 190 is oriented such that the posts 192 are pointed generally up, and the gates 141 return to their upright positions.

In this arrangement, the gates 141 block forward movement of any racers who may line up for a start. The buttress 190 disables movement of the gates 141 from the upright position to the collapsed position; abutting contact between the confrontation face 196 of each brace 195 and the downstream faces 198 of the struts 151 prevents each gate 141 from moving downstream.

During a start, if a racer falls over one of the gates 141 just before the actuator 15ˆ energizes at the start of the race, the gate 141 will not crush the racer even though the actuator 15ˆ quickly moves forward. Rather, only some of the gates 141 fall into the collapsed position. The racers in starting positions behind the gates 141 that did properly collapse can launch forward.

A racer who has fallen onto the downstream side of one of the gates 141 cannot start, but he also will not be crushed. Even though the actuator 15ˆ is in the extended position so as to rotate the common bar 14ˆ into the second position, the racer's gate 141 will not collapse. The buttress 190 is rotated into the second position and enables collapse of the gate 141, but so long as there is an obstruction—the racer's body—downstream of the racer's gate 141, that gate 141 will not collapse onto that obstruction with harmful force.

A preferred embodiment is fully and clearly described above so as to enable one having skill in the art to understand, make, and use the same. Those skilled in the art will recognize that modifications may be made to the description above without departing from the spirit of the specification, and that some embodiments include only those elements and features described, or a subset thereof. To the extent that modifications do not depart from the spirit of the specification, they are intended to be included within the scope thereof.

What is claimed is:

1. A gate assembly for a bicycle race start, the gate assembly comprising:

a plurality of gates, each mounted in a separate start position along a bar to move between a closed position and an open position;

the bar is moveable between a first condition and a second condition;

buttresses, each coupled to the bar to move between first positions and second positions in response to movement of the bar between the first condition and the second condition, wherein each buttress corresponds to a respective one of the gates;

in the first condition of the bar, each buttress disables movement of the respective gate from the closed position to the open position; and in the second condition of the bar, each buttress enables movement of the respective gate from the closed position to the open position.

2. The gate assembly of claim 1, wherein the gates are mounted for free pivotal movement on the bar.

3. The gate assembly of claim 1, wherein each buttress comprises:

rings fixed to the bar to pivot with the bar;

a post projecting from each of the rings to pivot with the bar; and a brace extending laterally between the posts and across an underside of the gate.

4. The gate assembly of claim 3, wherein the rings of each buttress are outboard of the respective gate.

5. The gate assembly of claim 1, wherein each gate comprises:

a plate having an upstream end and an opposed downstream end; and a mass damper including a weight mounted for reciprocal movement between the upstream and downstream ends and for movement away from an underside of the gate.

6. The gate assembly of claim 1, wherein each gate comprises:

an upstream face; and a tread plate formed into the upstream face, the tread plate including a recessed surface below the upstream face and a plurality of projections arranged in columns projecting upwardly from the recessed surface.

7. The gate assembly of claim 6, wherein the upstream face of each gate further includes slots extending laterally across the upstream face.

8. The gate assembly of claim 6, wherein each gate further includes a spring biasing the gate toward the open position.

9. A gate assembly for a bicycle race start, the gate assembly comprising:

a plurality of gates mounted to a bar for pivotal movement between an upright position and a collapsed position for respectively closing and opening separate starting positions upstream of the gates;

buttresses, each mounted downstream of a corresponding respective gate, wherein each buttress is moveable between a first position and a second position;

in the first position of the buttress, the corresponding respective gate is disabled from moving from the closed position to the open position; and in the second position of the buttress, the corresponding respective gate is enabled to move from the closed position to the open position;

wherein each buttress comprises:

posts projecting from the bar to pivot with the bar; and a brace extending laterally between the posts and across an underside of the gate.

10. The gate assembly of claim 9, wherein the gates are mounted for free pivotal movement on the bar.

11. The gate assembly of claim 9, wherein each gate comprises:

a plate having an upstream end and an opposed downstream end; and a mass damper including a weight mounted for reciprocal movement between the upstream and downstream ends and for movement away from an underside of the gate.

12. The gate assembly of claim 9, wherein each gate comprises:

an upstream face; and a tread plate formed into the upstream face, the tread plate including a recessed surface below the upstream face and a plurality of projections arranged in columns projecting upwardly from the recessed surface.

13. The gate assembly of claim 12, wherein the upstream face of each gate further includes slots extending laterally across the upstream face.

14. The gate assembly of claim 12, wherein each gate further includes a spring biasing the gate toward the collapsed position.

15. A gate assembly for a bicycle race start, the gate assembly comprising:

a plurality of gates, each mounted in a separate start position along a bar to move between a closed position and an open position;

stop means on the bar which moves with the bar between first and second positions;

in the first position, the stop means disables movement of the gates from the closed position to the open position; and in the second position, the stop means enables movement of the gates from the closed position to the open position;

wherein the stop means includes, for each gate;

a post projecting from the bar to pivot with the bar, and a brace coupled to the post and extending laterally across an underside of the gate to confront the underside of the gate.

16. The gate assembly of claim 15, wherein the gates are mounted for free pivotal movement between the closed and open positions.

17. The gate assembly of claim 15, wherein each gate comprises:

a plate having an upstream end and an opposed downstream end; and a mass damper including a weight mounted for reciprocal movement between the upstream and downstream ends and for movement away from an underside of the gate.

18. The gate assembly of claim 15, wherein each gate comprises:

an upstream face; and a tread plate formed into the upstream face, the tread plate including a recessed surface below the upstream face and a plurality of projections arranged in columns projecting upwardly from the recessed surface.

19. The gate assembly of claim 15, wherein, for each gate, the post is configured to confront the underside of the gate.

20. The gate assembly of claim 15, wherein the brace of each respective gate is a single, common brace extending between the posts and across all of the gates to confront the underside of the gates.

* * * * *